US007878878B2

(12) United States Patent
Massaro

(10) Patent No.: US 7,878,878 B2
(45) Date of Patent: Feb. 1, 2011

(54) LIFE SIZE HALLOWEEN NOVELTY ITEM

(76) Inventor: Darren S. Massaro, 65 Hunter Rd., Lincoln Park, NJ (US) 07035

( * ) Notice: Subject to any disclaimer, the term of this patent is extended or adjusted under 35 U.S.C. 154(b) by 0 days.

(21) Appl. No.: 12/168,193

(22) Filed: Jul. 7, 2008

(65) Prior Publication Data

US 2010/0003888 A1 Jan. 7, 2010

(51) Int. Cl.
*A63H 13/02* (2006.01)

(52) U.S. Cl. ..... 446/296; 446/130; 446/166; 446/167; 446/295; 446/297; 446/304; 446/369; 446/397; 446/399; 446/472; 446/484; 446/489; 446/175; 446/475; 369/30.02; 434/1; 434/86; 434/256; D2/741

(58) Field of Classification Search ..... 446/130, 446/175, 166, 167, 295, 296, 297, 304, 369, 446/397, 399, 472, 489; 369/30.02; D2/741; 434/1, 86, 256
See application file for complete search history.

(56) References Cited

U.S. PATENT DOCUMENTS 1,937,397 A * 11/1933 Averill ..... 446/295
2,725,575 A * 12/1955 Colonna ..... 4/312
2,748,256 A * 5/1956 Moran ..... 362/362
2,883,794 A * 4/1959 Julius Ellman ..... 446/167
3,100,588 A * 8/1963 Pearson, Jr. ..... 222/156
3,250,910 A * 5/1966 Authier ..... 40/540
3,363,904 A * 1/1968 Elwell ..... 369/30.02
3,636,655 A * 1/1972 Porter et al. ..... 446/302
3,789,544 A * 2/1974 Thorn ..... 446/167
3,828,462 A * 8/1974 Morrison et al. ..... 446/167
3,837,111 A * 9/1974 Godfrey et al. ..... 446/73
3,883,986 A * 5/1975 Thorn ..... 446/167
3,888,023 A * 6/1975 Genin ..... 434/256
3,890,907 A * 6/1975 Peterson ..... 108/136
4,209,939 A * 7/1980 Pittala ..... 446/267
4,226,902 A * 10/1980 Webb ..... 428/7
4,257,188 A * 3/1981 Barker ..... 446/295
D262,097 S * 12/1981 Weixelman ..... D11/118
4,375,733 A * 3/1983 Callais, Jr. ..... 446/295
4,479,329 A * 10/1984 Fraden ..... 446/175
4,575,351 A * 3/1986 Gonzalez ..... 446/371
4,582,317 A * 4/1986 Provenzano, Jr. ..... 472/70
4,683,588 A * 7/1987 Goldberg ..... 381/61
4,690,653 A * 9/1987 Goldberg ..... 446/27

(Continued)

*Primary Examiner*—Gene Kim
*Assistant Examiner*—Alexander R Niconovich
(74) *Attorney, Agent, or Firm*—Brown & Michaels, PC; Michael F. Brown

(57) ABSTRACT

A Halloween novelty item used for entertainment consisting of a removable reservoir of fluid and a timed electromagnetic valve inside a head that is activated by a motion sensor whereby allowing fluid to expel intermittently out of orifices attached to a tongue when the Halloween novelty item is approached. The expelled fluid is caught by a bucket attached to a slide bracket which is attached to a body panel whereby allowing the bucket to be removable. An assembly attached to a bucket handle consisting of a pair of hooks attached to a pair of hands connected to a pair of flexible arms allows the assembly to detach from the bucket's handle. A stabilization board keeps the novelty item stable. Motion sensors facing different directions are attached to a voice recorder and a speaker allowing messages to play. A hinge and latches attached to the body allows the invention to condense.

10 Claims, 14 Drawing Sheets

U.S. PATENT DOCUMENTS 4,837,958 A * 6/1989 Radovich ..... 40/538
4,883,749 A * 11/1989 Roberts et al. ..... 434/247
5,011,161 A * 4/1991 Galphin ..... 273/349
5,186,675 A * 2/1993 Stoddard ..... 446/199
5,195,638 A * 3/1993 Zinbarg ..... 206/457
5,207,728 A * 5/1993 Fogarty et al. ..... 446/98
5,211,996 A * 5/1993 Zinbarg ..... 428/16
5,228,140 A * 7/1993 Baustin ..... 2/93
D341,636 S * 11/1993 Kennedy ..... D21/631
5,267,886 A * 12/1993 Wood et al. ..... 446/175
5,285,898 A * 2/1994 Zinbarg et al. ..... 206/457
5,337,956 A * 8/1994 Crutcher ..... 239/27
5,358,763 A * 10/1994 Zinbarg ..... 428/16
5,386,909 A * 2/1995 Spector ..... 206/457
5,494,472 A * 2/1996 Levy et al. ..... 446/295
5,584,741 A * 12/1996 Cheung ..... 446/300
5,613,464 A * 3/1997 Petzel ..... 119/55
5,682,701 A * 11/1997 Gammon ..... 43/2
D391,190 S * 2/1998 Cohen ..... D11/121
5,718,572 A * 2/1998 Hitzel ..... 431/292
5,733,170 A * 3/1998 Wotton ..... 446/385
5,799,609 A * 9/1998 Burns et al. ..... 119/74
5,878,956 A * 3/1999 Djukastein et al. ..... 239/69
5,890,907 A * 4/1999 Minasian ..... 434/247
5,975,979 A * 11/1999 Ferri Llorens ..... 446/301
6,017,261 A * 1/2000 Wachtel ..... 446/301
6,048,209 A * 4/2000 Bailey ..... 434/267
6,071,169 A * 6/2000 Cook ..... 446/300
6,082,633 A * 7/2000 Kephart et al. ..... 239/211
6,093,475 A * 7/2000 Geller ..... 428/166
D430,817 S * 9/2000 Salandra ..... D11/121
6,193,580 B1 * 2/2001 Albert et al. ..... 446/297
6,202,594 B1 * 3/2001 Kirschner ..... 119/72
6,261,186 B1 * 7/2001 Henry ..... 472/128
6,471,565 B2 * 10/2002 Simeray ..... 446/298
6,500,041 B1 * 12/2002 Crome, Jr. ..... 446/27
6,526,916 B1 * 3/2003 Perlsweig ..... 119/74
6,539,655 B1 * 4/2003 Earle ..... 40/419
6,546,654 B1 * 4/2003 Henson ..... 40/606.1
6,561,914 B2 * 5/2003 Henry ..... 472/13
6,574,800 B1 * 6/2003 Leger et al. ..... 2/114
6,592,426 B2 * 7/2003 Mesch ..... 446/310
6,739,979 B2 * 5/2004 Tracy ..... 472/128
6,764,201 B2 * 7/2004 Chi-Cheng ..... 362/352
6,793,551 B1 * 9/2004 Rehkemper et al. ..... 446/130
6,883,563 B2 * 4/2005 Smith ..... 141/94
6,902,339 B2 * 6/2005 King ..... 401/270
6,904,612 B2 * 6/2005 Spongberg ..... 2/69
6,905,388 B2 * 6/2005 Schoonmaker ..... 446/153
6,955,454 B2 * 10/2005 Trappani et al. ..... 362/351
7,247,076 B2 * 7/2007 Dang et al. ..... 446/102
7,435,153 B1 * 10/2008 Sodec, Jr. ..... 446/295
7,594,669 B2 * 9/2009 Acosta ..... 280/79.5
7,606,637 B2 * 10/2009 Habing ..... 700/284
7,611,073 B2 * 11/2009 Crutcher ..... 239/25
7,637,794 B2 * 12/2009 Barri et al. ..... 446/175
7,673,907 B2 * 3/2010 Nenov et al. ..... 280/811
2001/0013188 A1 * 8/2001 Hall ..... 40/610
2002/0068502 A1 * 6/2002 Kownacki ..... 446/465
2002/0086607 A1 * 7/2002 Chan ..... 446/175
2002/0098770 A1 * 7/2002 Mesch ..... 446/310
2002/0141189 A1 * 10/2002 Lin ..... 362/294
2002/0182975 A1 * 12/2002 Schaffer ..... 446/327
2003/0143918 A1 * 7/2003 Becking ..... 446/268
2003/0190858 A1 * 10/2003 Thomas ..... 446/484
2004/0077272 A1 * 4/2004 Jurmain et al. ..... 446/268
2004/0152394 A1 * 8/2004 Marine et al. ..... 446/175
2004/0180603 A1 * 9/2004 Barri et al. ..... 446/175
2004/0198139 A1 * 10/2004 Atobe et al. ..... 446/74
2005/0008423 A1 * 1/2005 King ..... 401/270
2005/0081442 A1 * 4/2005 Mansfield ..... 47/83
2005/0190556 A1 * 9/2005 Machala ..... 362/294
2006/0003664 A1 * 1/2006 Yeh ..... 446/175
2006/0009113 A1 * 1/2006 Fong et al. ..... 446/175
2006/0025037 A1 * 2/2006 Lau ..... 446/226
2006/0052031 A1 * 3/2006 Parpia ..... 446/304
2006/0111012 A1 * 5/2006 Machala ..... 446/226
2006/0119482 A1 * 6/2006 Hanscom ..... 340/573.1
2006/0230676 A1 * 10/2006 Rowe et al. ..... 47/66.6
2007/0060020 A1 * 3/2007 Civettini et al. ..... 446/484
2007/0095297 A1 * 5/2007 Boyd ..... 119/74
2007/0111632 A1 * 5/2007 Clark ..... 446/175
2007/0207697 A1 * 9/2007 Chin et al. ..... 446/175
2007/0235957 A1 * 10/2007 Nenov et al. ..... 280/11.12
2007/0262099 A1 * 11/2007 Eimer ..... 222/494
2008/0009223 A1 * 1/2008 Vairo Gaddi ..... 446/270
2008/0014830 A1 * 1/2008 Sosnovskiy et al. ..... 446/297
2008/0033601 A1 * 2/2008 Habing ..... 700/284
2008/0050998 A1 * 2/2008 Polfliet et al. ..... 446/72
2008/0190374 A1 * 8/2008 Farris ..... 119/74
2008/0250914 A1 * 10/2008 Reinhart et al. ..... 84/645
2009/0053971 A1 * 2/2009 Hui ..... 446/295
2009/0098791 A1 * 4/2009 Wang et al. ..... 446/175
2009/0104844 A1 * 4/2009 Chen ..... 446/376
2009/0111352 A1 * 4/2009 Hui ..... 446/142
2009/0129089 A1 * 5/2009 LaVallee ..... 362/249.16
2009/0130942 A1 * 5/2009 Post ..... 446/27
2009/0154142 A1 * 6/2009 Denham ..... 362/103
2009/0156089 A1 * 6/2009 Hoard et al. ..... 446/297
2009/0156092 A1 * 6/2009 Zawitz ..... 446/438
2009/0181598 A1 * 7/2009 Baytman et al. ..... 446/484
2009/0209170 A1 * 8/2009 Richter ..... 446/297
2009/0212123 A1 * 8/2009 Crutcher ..... 239/25
2009/0283542 A1 * 11/2009 Cruysberghs ..... 222/129

* cited by examiner

FIG. 8
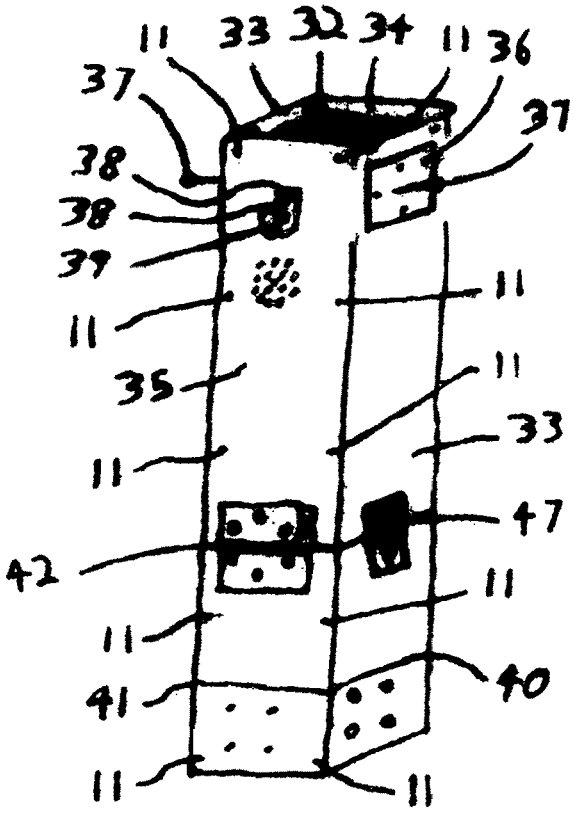
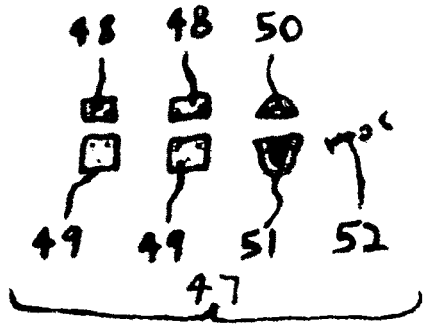
FIG. 9
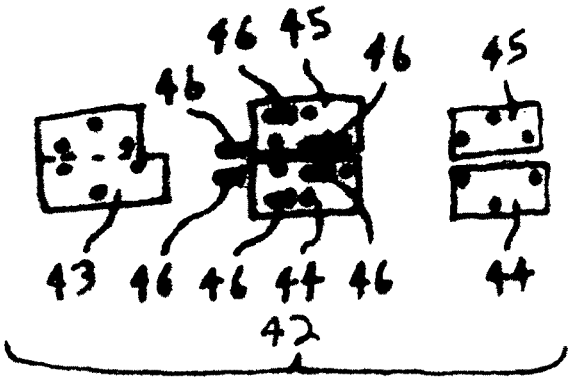
FIG. 10

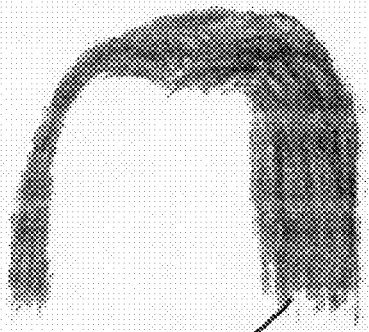
FIG.26A
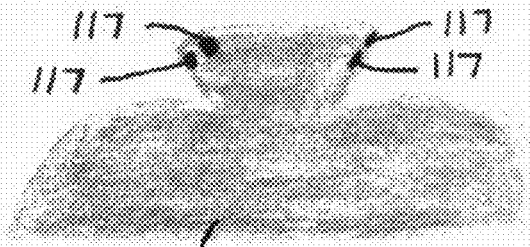
FIG.26B
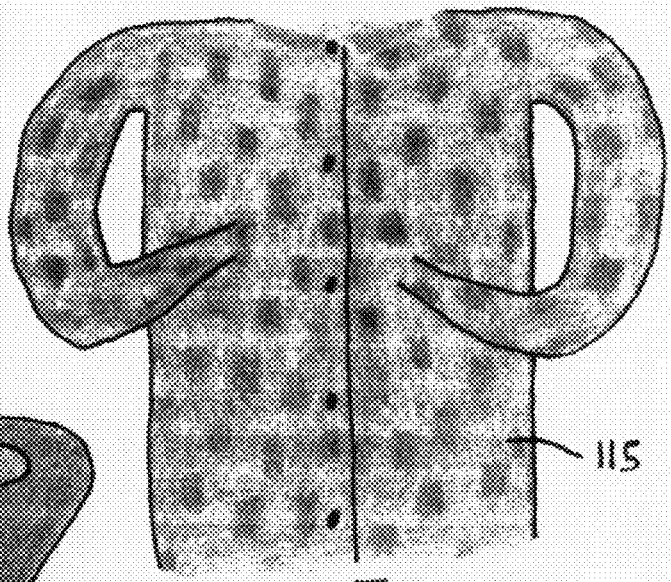
FIG.26C
FIG.26D
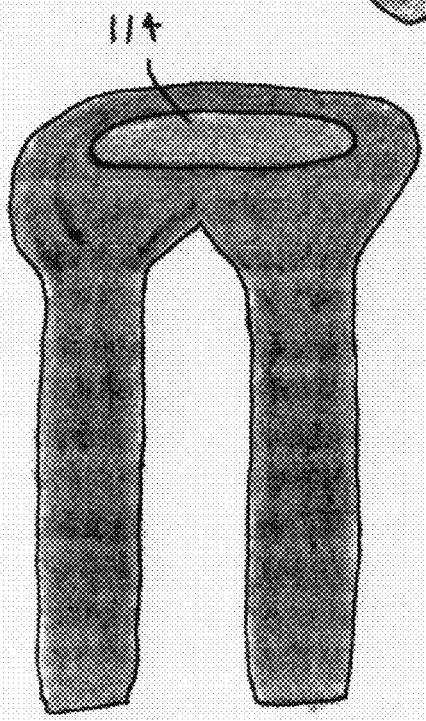
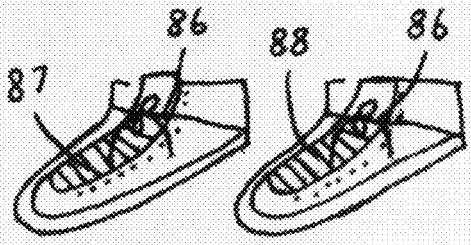
FIG.26E

LIFE SIZE HALLOWEEN NOVELTY ITEM

BACKGROUND OF THE INVENTION

The present invention in general relates to seasonal novelty items used for entertainment during the Halloween season that are condensable, animated figures comprising motion sensors, voice recorders, speakers, battery boxes, detachable candy bowls and more particularly to a Halloween novelty item comprising multiple motion sensors, a battery box, a message box, a speaker, a message switch, quick detachable hands/gloves, and a detachable fluid jug assembly located inside a head cavity capable of throwing up into a detachable bucket and saying different messages when approached from different angles.

Today, people have a growing interest in Halloween novelty items that are, distinctive, affordable, attainable and easy to use but still have new features. No prior art could be found, however knowledge of other Halloween novelty items fore sale have candy bowls attached to their hands and to detach them for cleaning or storage is awkward and time consuming. Investigation of other Halloween novelty items expelling fluid from a mouth orifice require an air compressor to operate, cost thousands of dollars and are unavailable to regular retail stores to sell due to their costs. Known knowledge of other novelty items require you to walk right in front of them to work but you can approach this particular Halloween novelty item invention from three different angles and it will work the messages however, it will only expel fluids when approached from the front. Other known knowledge of Halloween novelty items is the use of plastic shafts with large springs which have to be pushed down into latches to condense for shipping and storage and are unreliable. This particular invention folds in half to condense using a simple hinge and two straps.

Accordingly, there is a need for an affordable easy to use foldable Halloween novelty item that can expel fluid intermittently from a pair of tongue orifices into a detachable bucket that the Halloween item appears to be holding further using a removable, and refillable fluid jug assembly capable of utilizing gravity to expel the fluid. Even further a Halloween novelty item that can say different messages when approached from different angles and is also inexpensive to fabricate.

SUMMARY OF THE INVENTION

The present invention includes a life-size Halloween novelty item having a head cavity, a body assembly, hands/gloves, flexible arms, a hinge, latches and a stabilization board in combination with a detachable bucket. The present invention includes a removable fluid jug assembly consisting of a cap, a rubber belt and an electromagnetic valve contained within the head cavity that can be filled with fluid by removing a wig and unscrewing the fluid jug's cap. The electromagnetic valve is connected to the bottom of the fluid jug and is also connected to a motion sensor, a timer, a tube, and a two way splitter. The two way splitter is attached to a tongue where the fluid ultimately is expelled when someone approaches the front of the present invention. The motion sensor, timer, and electromagnetic valve are powered using an AC/DC 12 volt adapter plugged into a regular house outlet and an on/off switch. The combination of a timer connected to an electromagnetic valve allows the fluid to be expelled through dual orifices intermittently through the two way splitter attached to the tongue. The fluid jug can be removed so unused fluid can be disposed of. The fluid jug assembly sits on a set of rails and has a rubber belt around it allowing it to be secure and at the same time being removable from the top of the head by removing a wig, and a neck fabric with magnets sewn in which connects to a pair of neck brackets which enables the user to disconnect the electromagnetic valve's tube and wires. The present invention also includes three other motion sensors, a message box, a message switch, a battery box, an on/off switch and a volume control.

The detachable bucket connects to the Halloween novelty item using slide type brackets. The hands/gloves are connected to arms which are made out of chain link and pipe insulation making them extremely flexible. The hands have hooks sewn into them to hook or unhook from the bucket's handle producing the illusion that the present invention is actually holding the bucket with it's hands to throw up into it. The message (voice recorder) motion sensors are positioned on the present invention in different directions so when the present invention is approached from the left, right, or front it will say preinstalled scary messages, further a different message will play depending on what angle someone approaches the present invention and the message switch position. The present invention is foldable using a hinge attached to the front of the body assembly. When the present invention is erected it uses three latches attached to the sides and back of the body panel assembly to keep it upright.

It is acknowledged that this Halloween novelty item can be built using different processes eliminating the use of wood, most metal, and many nuts and bolts which would reduce the weight and time to produce it, but still look and perform the same. Further it is acknowledged that this Halloween novelty item can be produced at a multitude of different sizes, exp; life-size, table top size, small, large, big, tall, little, midget, dwarf, etc

BRIEF DESCRIPTION OF THE DRAWINGS

The above description of the present invention will be more fully understood by reference to the following detailed description in conjunction with the accompanying drawings wherein.

FIG. 2 also shows the attachment of a nose, a left ear, a chin, a pair of left upper neck bracket and the top of a fluid jug and a cap. The fluid jug holds the reservoir of fluid inside the head cavity. FIG. 2 also shows the attachment of a nose, a left ear, a chin, a pair of left upper neck bracket and the top of a fluid jug and a cap. The neck brackets connect the head cavity to the body panel assembly (FIG. 8).

FIG. 5 Further shows an electromagnetic valve's shaft, nut, and rubber washer, which protrudes into the fluid jug's bottom interior connecting the two.

FIG. 26A is a perspective elevation of a wig which covers the head cavity (FIG. 2).

FIG. 26B is a perspective elevation of a neck fabric with it's four magnets sewn into the top corners of the neck fabric. The neck fabric magnets connects the neck fabric to the upper right and upper left neck brackets (FIG. 2 & FIG. 3) in order to hide the inner components of the present invention FIG. 26C is a perspective elevation of a flannel shirt which covers the body panel and arm assemblies FIG. 26D is a perspective elevation of a pair of sweat pants which covers the present invention's leg and hip assemblies.

FIG. 26E is a perspective elevation of a pair of running shoes.

DETAILED DESCRIPTION OF THE DRAWINGS

Referring specifically to the drawings, there is shown in

Figure 1:
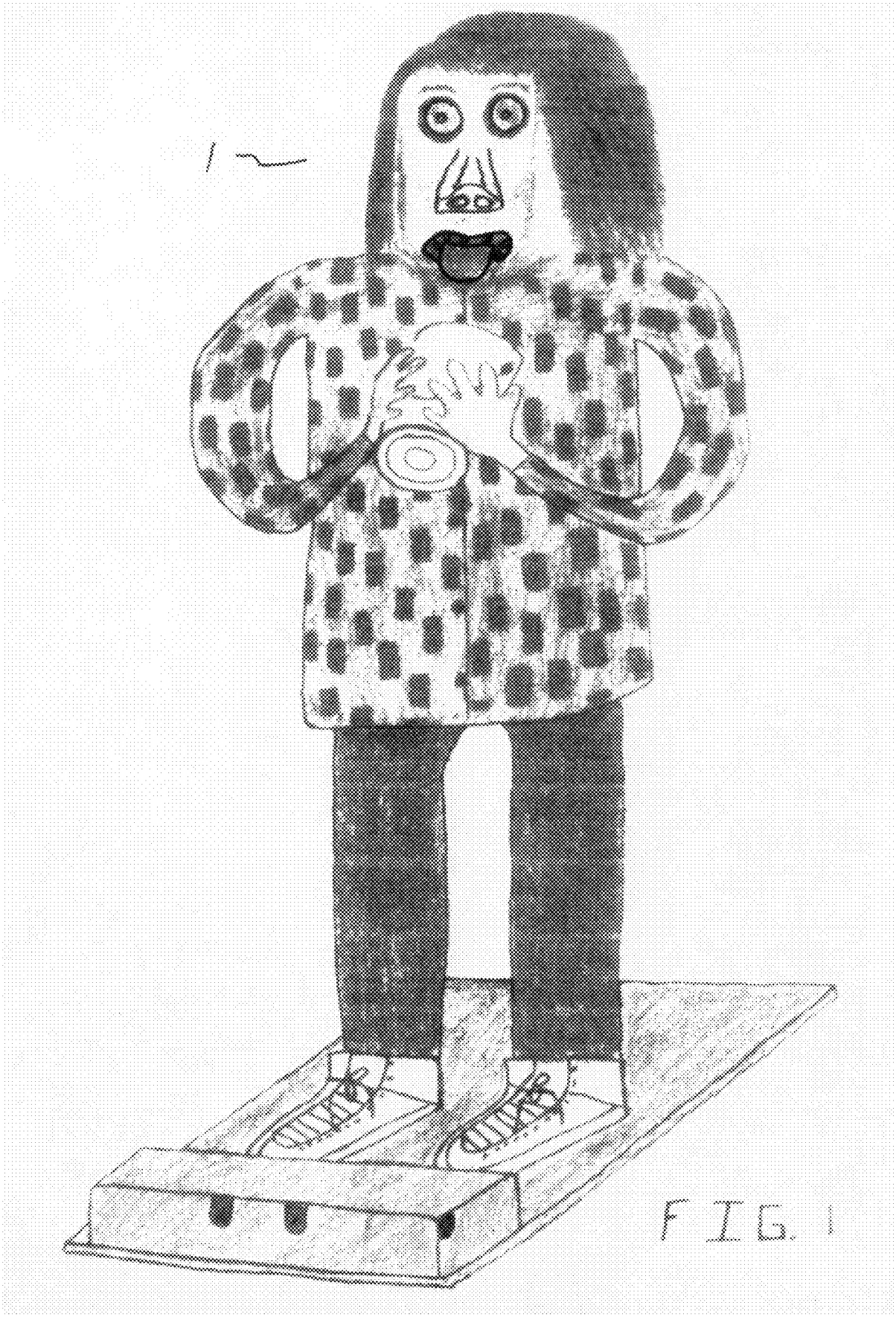
FIG. 1 is a perspective elevation of a Halloween novelty item that is foldable, can expel a fluid intermittently via gravity from orifices located on a tongue into a removable bucket that looks like the present invention is holding with a pair of gloves when the Halloween novelty item is approached from the front, and play different messages when the Halloween novelty item is approached from the sides and the front, in turn FIG. 1's purpose is to show what the Halloween novelty item looks like when standing and ready for use and to give a perspective of the following figures and their assemblies.

FIG. 1, 1 shows a perspective elevation of a Halloween novelty item specifically designed to contain a refillable reservoir of fluid inside a head cavity with a bucket located underneath a pair of tongue orifices to catch fluid expelled whereby leaving the impression that the present invention is throwing up. Further FIG. 1 shows the present invention having a pair of chain link arms with a pair of hands hooked onto a bucket so it looks like the present invention is actually holding the bucket to throw up into it. Further, you can see in FIG. 1 a motion sensor box located on a stabilization board at the bottom of the present invention which contains a set of four motion sensors that activate voice recordings and the throwing up. All the items mentioned above and more will be explained in detail from the uppermost part of the present invention to the bottom most part of the present invention in the following figures.

Figure 2:
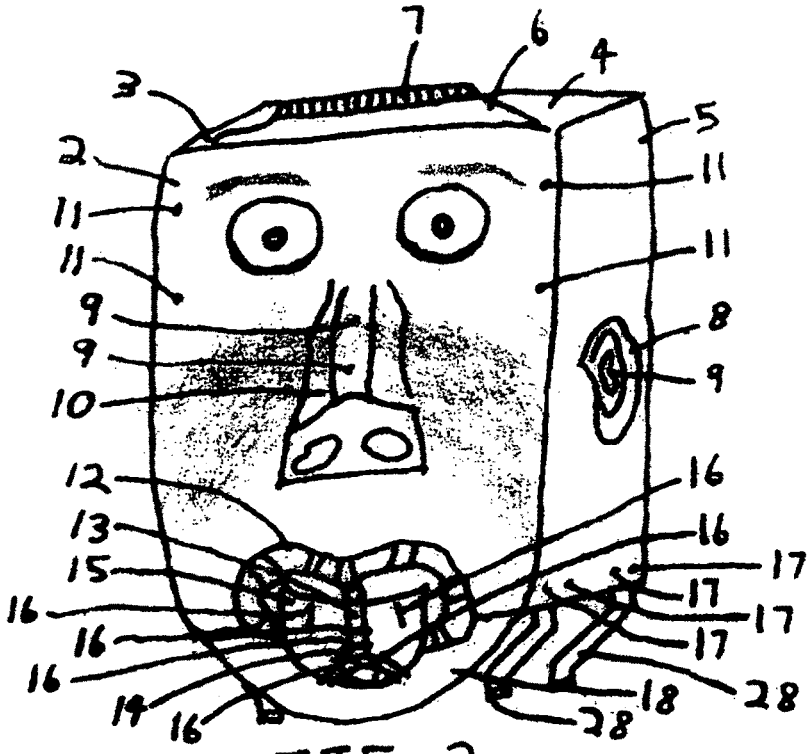
FIG. 2 is a perspective elevation of the front of a head cavity shows a recessed eye design, a lip design, and a protruding tongue. The tongue has a tube and a two way splitter attached underneath a wood putty allowing fluid to be expelled from dual orifices located on the tongue.

FIG. 2 shows a left hand front view of a face and a head cavity. The face 2 has a pair of recessed eyes with a pair of holes in their middle for a distinctive look. The face 2 is assembled to the left side of a head cavity 5 and the right side of a head cavity 3 using a set of four wood screws 11. A nose 10 which having a pair of recessed holes is attached to the face 2 using two wood screws 9 which go into the recessed holes of the nose 10. A pair of lips 12 are attached to the bottom of the face 2 using epoxy glue. For reinforcement the lips 12 have two protruding pieces on their back that fit into two recessed parts on the bottom of the face 2. A tongue 15 fits snugly between a pair of lips 12. The tongue 15 is attached to the lips 12 using a pair of heavy duty wire twists 16. The tongue 15 acts as a support for a tube 13, which is attached to the middle of the tongue 15, using one heavy duty wire twist 16. A two way-splitter 14 is attached to the end of the tongue 15, using three heavy duty wire twists 16. The tongue 15, the rubber tube 13, the two way splitter 14, and a set of six wire twists 16 are covered using a wood putty hiding all the parts on the tongue 15 except for the very end of the two way splitter 14 where ultimately the fluid (throw up) will flow out of. A Left ear 8 is attached to the left part of the head cavity 5 using one wood screw 9. A set of four bolts and nuts 17 are used to connect a pair of left upper neck brackets 28 to the bottom left of the head cavity 5. The Left head cavity 5, the right head cavity 3, A rear head cavity 4 and the face 2 holds a fluid jug 6 and a cap 7 in place.

Figure 3:
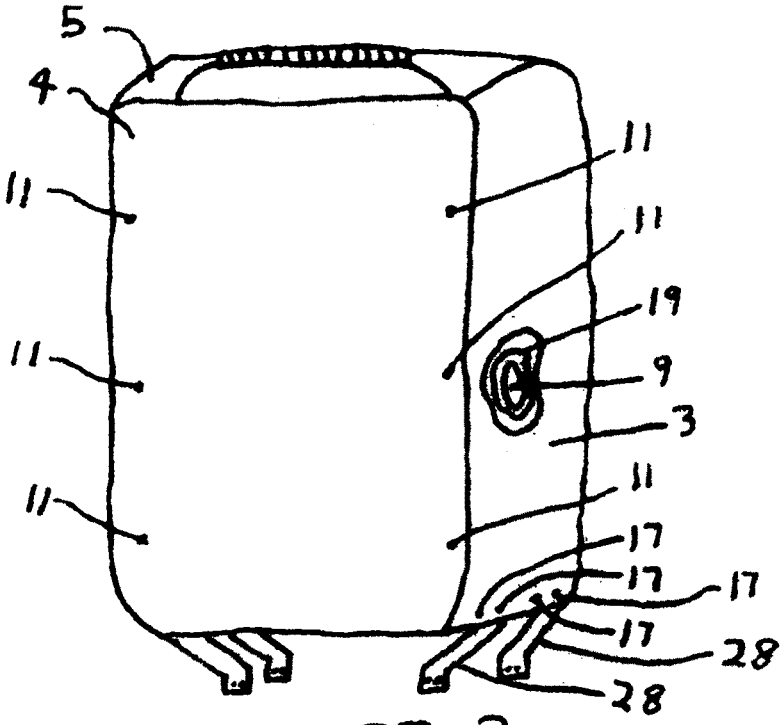
FIG. 3 is a close up perspective elevation of the rear of the head cavity showing a right ear and a pair of right upper neck brackets. The neck brackets connect the head cavity to the body panel assembly (FIG. 8).

FIG. 3 shows a right ear 19 attached to the right side of the head cavity 3 using one wood screw 9. The rear of the head cavity 4 is attached to the left side of the head cavity 5 and the right side of the head cavity 3 using a set of six wood screws 11. A set of four bolts and nuts 17 are used to attach a pair of right upper neck brackets 28 to the bottom right of the head cavity 3.

Figure 4:
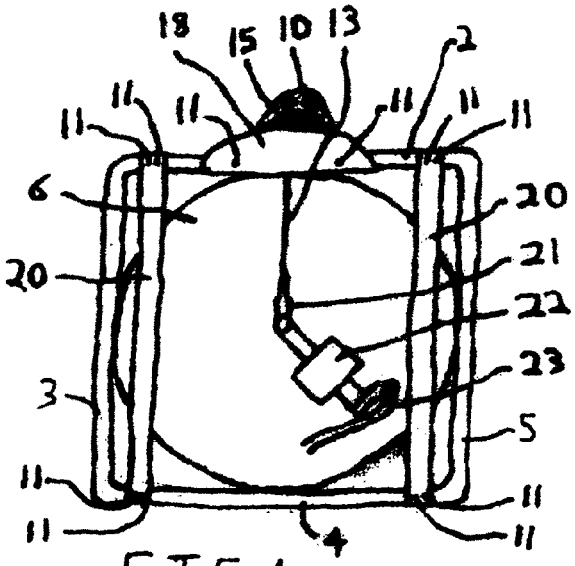
FIG. 4 is a close up perspective elevation of the bottom of the head cavity showing a chin, a fluid jug sitting on two support strips, and an electromagnetic valve with it's wiring and a tube attached at the bottom of the fluid jug The electromagnetic valve in communication with a motion sensor and a power supply allows the fluid to expel from the fluid jug through the tongue orifices via gravity.

FIG. 4 shows a bottom view of the head cavity parts 3,4, and 5 and the face 2. A chin 18 has a pair of two recessed holes and is attached to the bottom of the face 2 using a pair of wood screws 11 which go through the recessed holes located at the bottom of the chin 18. A fluid jug 6 has an electromagnetic valve 22, a pair of positive and negative wire connectors 23, an elbow fitting 21, and the tube 13 attached to it's bottom. The tube 13 and the positive and negative wire connectors 23 disconnect from the electromagnetic valve 22 so the fluid jug 6 can be removed from the head cavity parts 3,4, and 5 and the face 2. A pair of rails 20 are attached to the bottom of the face 2 and the rear of head cavity part 4 using a set of eight wood screws 11. The purpose of the two rails 20 is to hold the fluid jug 6 and it's components consisting of a rubber belt 24 and the electromagnetic valve 22 from falling out of the head cavity parts 3,4, and 5 and face 2. Since the fluid jug 6 is located inside the head cavity parts 3,4 and 5 and face 2 which is the highest point of the present invention permits the use of gravity for the purpose of throwing up a fluid into a bucket 75, (FIG. 17), also eliminating the need for a pump. A cap 7 positioned on the top of the fluid jug 6 is used for filling the fluid jug 6. The cap 7 must be left a quarter turn loose for the fluid to flow out of the fluid jug 6.

Figure 5:
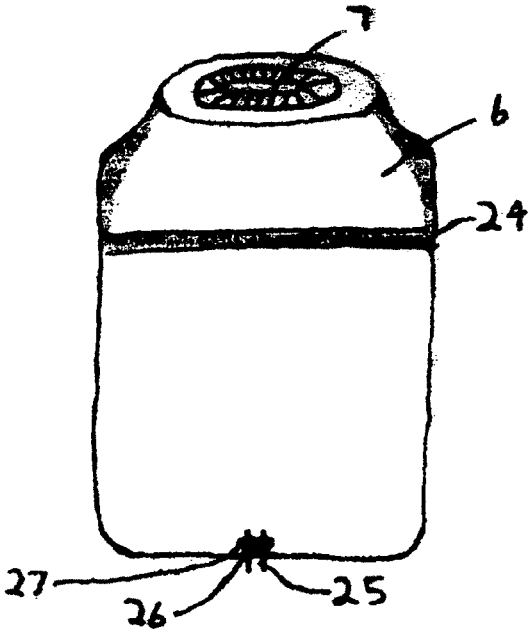
FIG. 5 is a close up perspective elevation of the fluid jug, a cap, and a rubber belt which contacts the inside of the head cavity for stability when screwing or unscrewing the cap when filling up the fluid.

FIG. 5 shows the fluid jug 6 which has the rubber belt 24 around it. The purpose for the belt 24 is to hold the fluid jug 6 in place while the operator screws and unscrews the fluid jug's cap 7 while the fluid jug 6 sits inside the head cavity parts 3,4 and 5 and face 2 (FIG. 3). A fitting 25 is screwed into the bottom of the fluid jug 6 and has a rubber washer 26 and a flat large nut 27 which keeps the fluid jug 6 from leaking water. The fitting 25 connects the fluid jug 6 to the electromagnetic valve 22, (FIG. 4).

Figure 6:
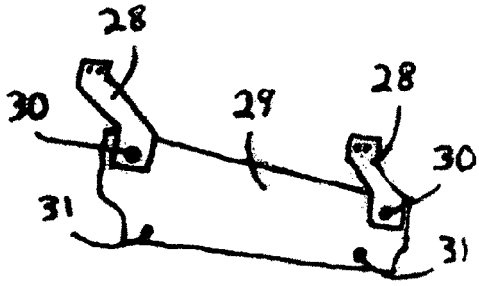
FIG. 6 is a close up perspective elevation of a left lower neck bracket, a pair of left upper neck brackets, and their attaching hardware which connect the head cavity to the body panel assembly.
Figure 8:
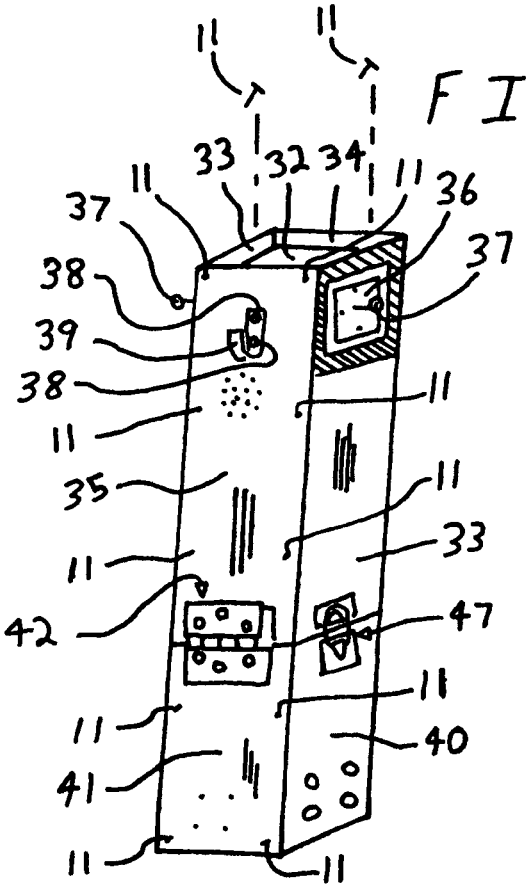
FIG. 8 is a perspective elevation of a body panel assembly with multiple speaker holes, a waterproof plastic insert for protecting the electrical components, a slide bracket for a bucket attachment, a left arm and a left shoulder attachment part, a left latch assembly, a hinge assembly and a left leg assembly with attachment holes.

FIG. 6 Shows a right lower neck bracket 29 which is attached to a right upper body panel 33, FIG. 8 (FIG. 8) using a pair of bolts, nuts, and washers 31. A pair of right upper neck brackets 28 are connected to a right lower neck bracket 29 using a pair of bolts and locking nuts 30.

Figure 7:
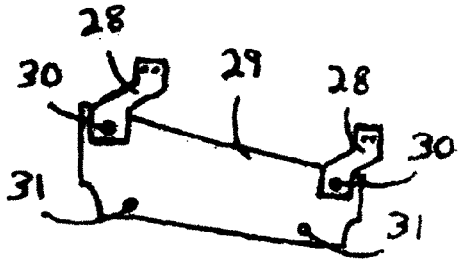
FIG. 7 is a close up perspective elevation of a right lower neck bracket, a pair of right upper neck brackets and their attaching hardware which connect the head cavity to the body panel assembly.

FIG. 7 shows a left lower neck bracket 29, it's attachment hardware 31, a pair of left upper neck brackets 28 and their attaching hardware 30. FIG. 7 is identical to FIG. 6 meaning the parts are identical. The only difference is that the parts in FIG. 7 attaches to a left upper body panel 33 (FIG. 8).

FIG. 8 shows a left hand frontal view of a body panel assembly consisting of multiple body panels with the left upper body panel 33 removed showing a shoulder reinforcement piece 36 and body panels 33, 34, and 35 internally attached parts. A right upper and a left upper body panel 33 have a pair of shoulder reinforcement pieces 36 located on the inner top sections of body panels 33 with a pair of eye bolts 37 screwed into both upper body panels 33 and both shoulder reinforcement pieces 36. The purpose of the eye bolts 37 are to attach a pair of chain link arms 70, (FIG. 13 & FIG. 14) to the upper body panels 33. Located inside the right upper and the left upper body panels 33, a rear upper body panel 34, and a front upper body panel 35 is a plastic insert 32 which is siliconed in to prevents any spillage from the fluid jug 6, (FIG. 5) from entering the inside of the upper body panels 33, 34 and 35 where many electrical devices are located. The left upper body panel 33 and a lower body panel 40 has a latch assembly 47 attached to them. The front upper body panel 35 has holes drilled into it underneath the rear of a bucket bracket 39 for a speaker 54, FIG. 11. The slide bracket 39 is attached to the front upper body panel 35 using a set of two bolts, lock washers, washers, and nuts 38. The bucket bracket 39 holds the bucket 75, (FIG. 18) and allows the bucket to slide on and off of the present invention. The front upper body panel 35 is attached to the right upper and the left upper body panels 33 using a set of six wood screws 11. A front lower body panel 41 is attached to a left lower body panel 40 and a right lower body panel 60, (FIG. 11) using a set of four wood screws 11.

Figure 9:
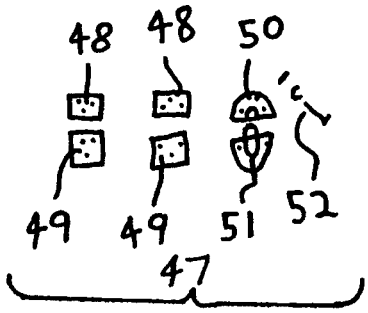
FIG. 9 is an exploded perspective elevation of a latch assembly which the present invention has three actual latch assemblies that are located on the left, the right and the rear of the present invention which holds the present invention in place when erected.

FIG. 9 shows a latch assembly 47 which has a pair of upper latch reinforcement pieces 48 located on the inside and outside of the corresponding body panel 33. The latch 47 has a latch holder 50 which is attached to the left upper latch reinforcement pieces 48, and the left upper body panel 33 using a set of three screws, lock washers, and nuts 52. The latch assembly 47 has a pair of lower latch reinforcement pieces 49 that are attached to the inside and outside of the left lower body panel 40, (FIG. 8). The latch assembly 47 has a latch lever 51 which is attached to the lower left body panel 40, (FIG. 8) using a set of three screws, lock washers, and nuts 52.

Figure 10:
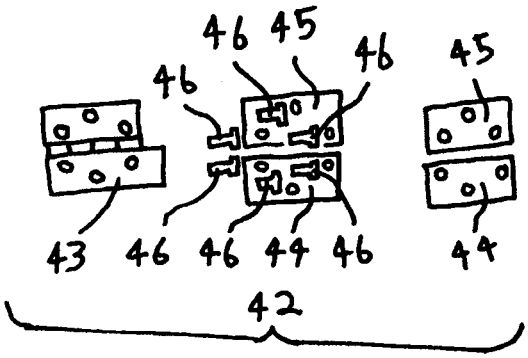
FIG. 10 is an exploded perspective elevation of a hinge assembly and it's components allowing the present invention to fold in half.
Figure 11:
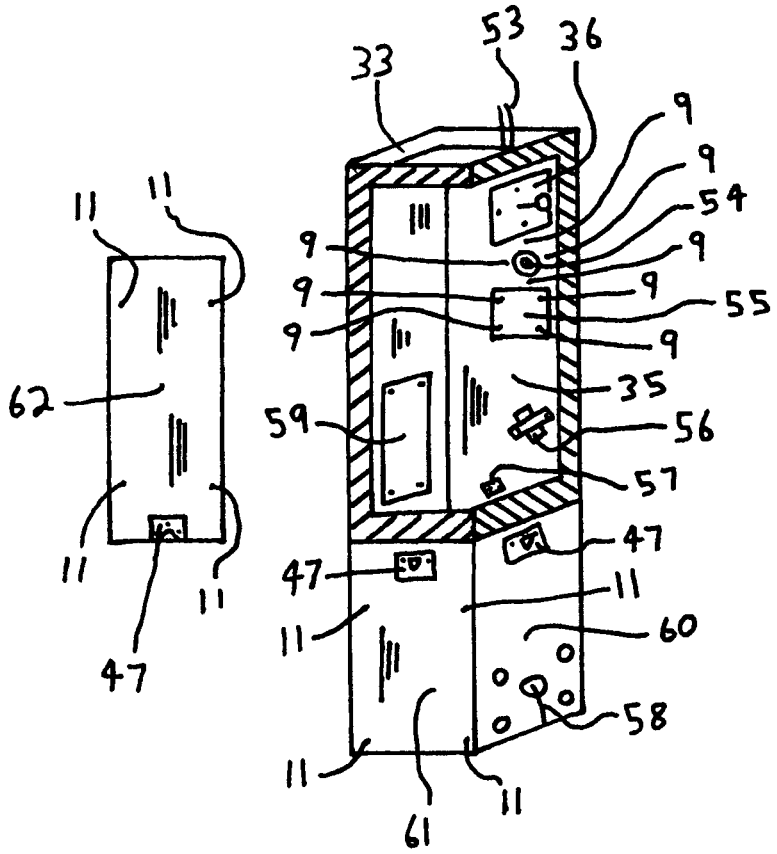
Figure 12:
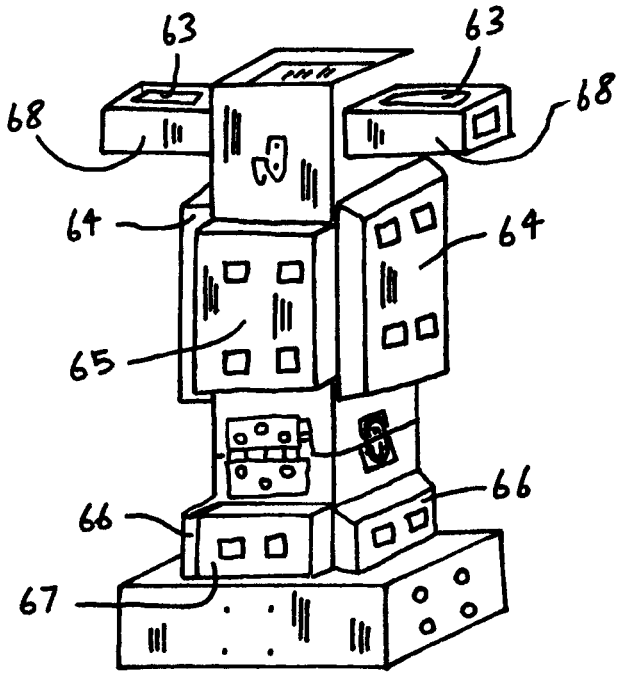
Figure 13:
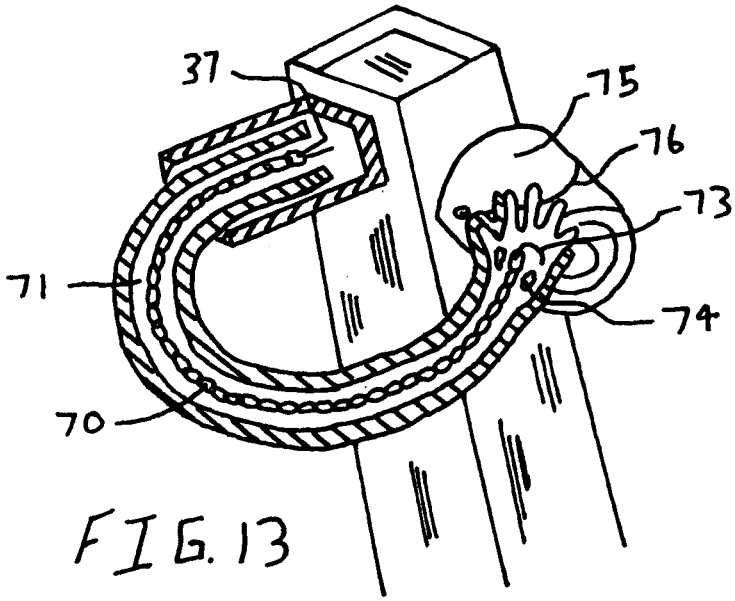
Figure 15:
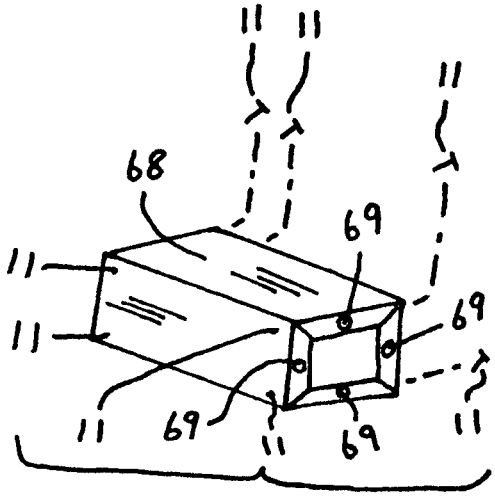
Figure 14:
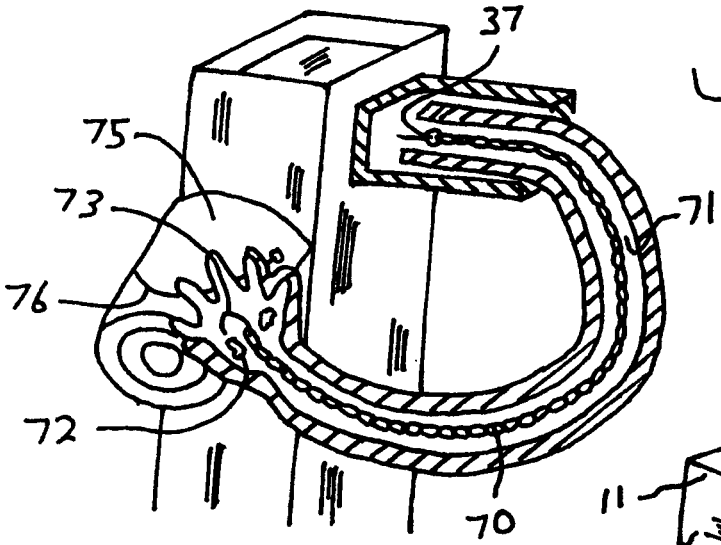
Figure 16:
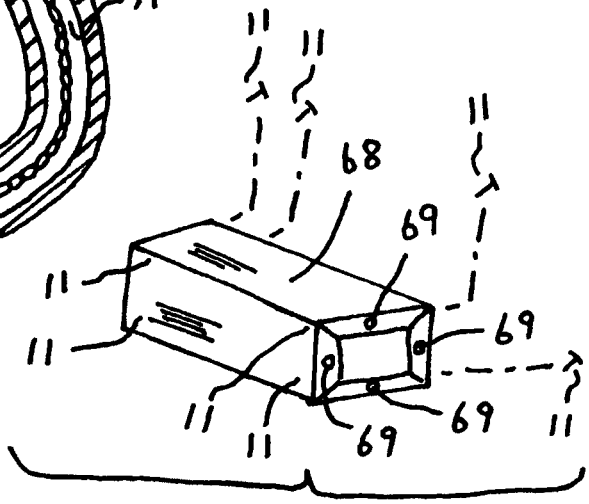
Figure 17:
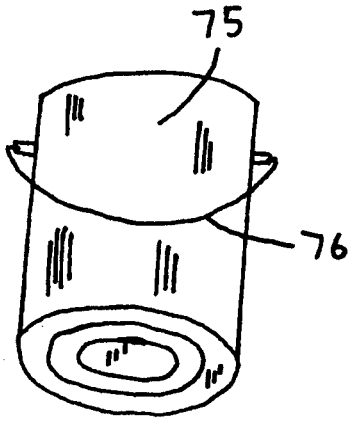
Figure 18:
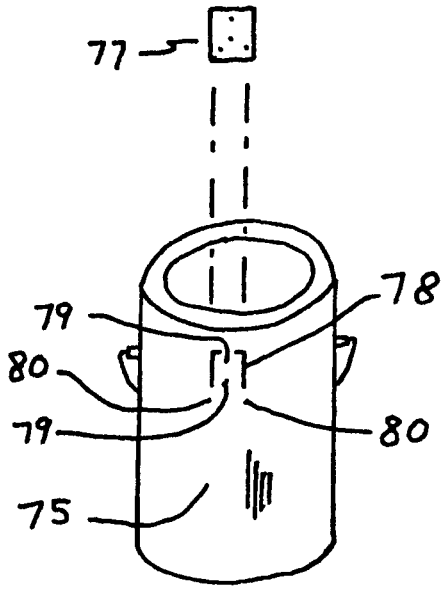
Figure 19:
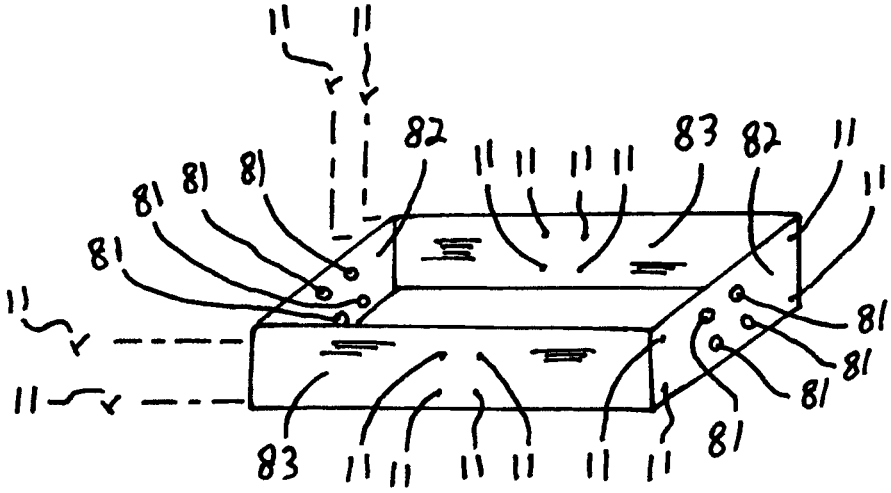
Figure 20:
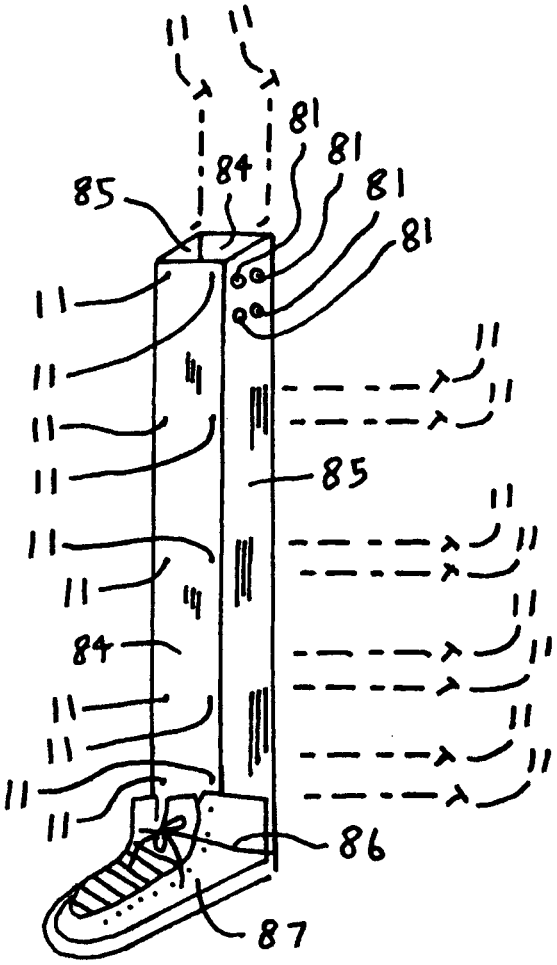
Figure 21:
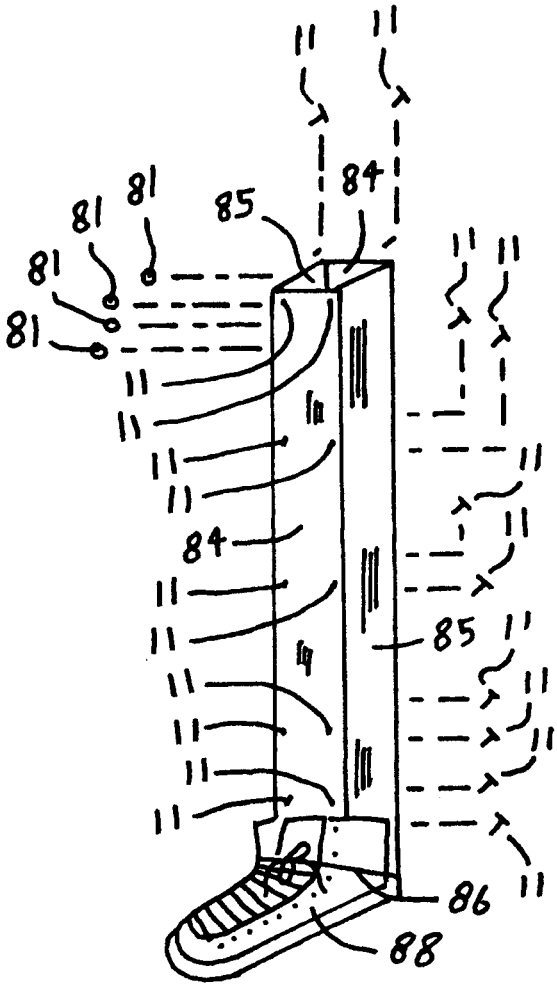
Figure 22:
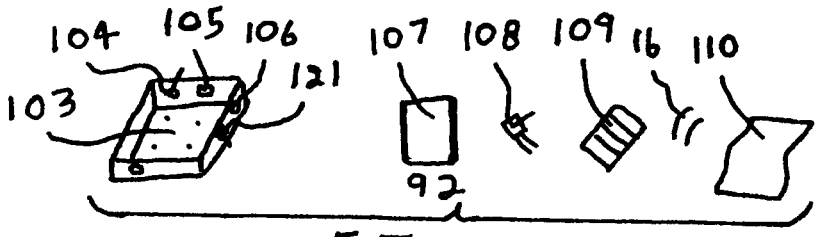
Figure 23:
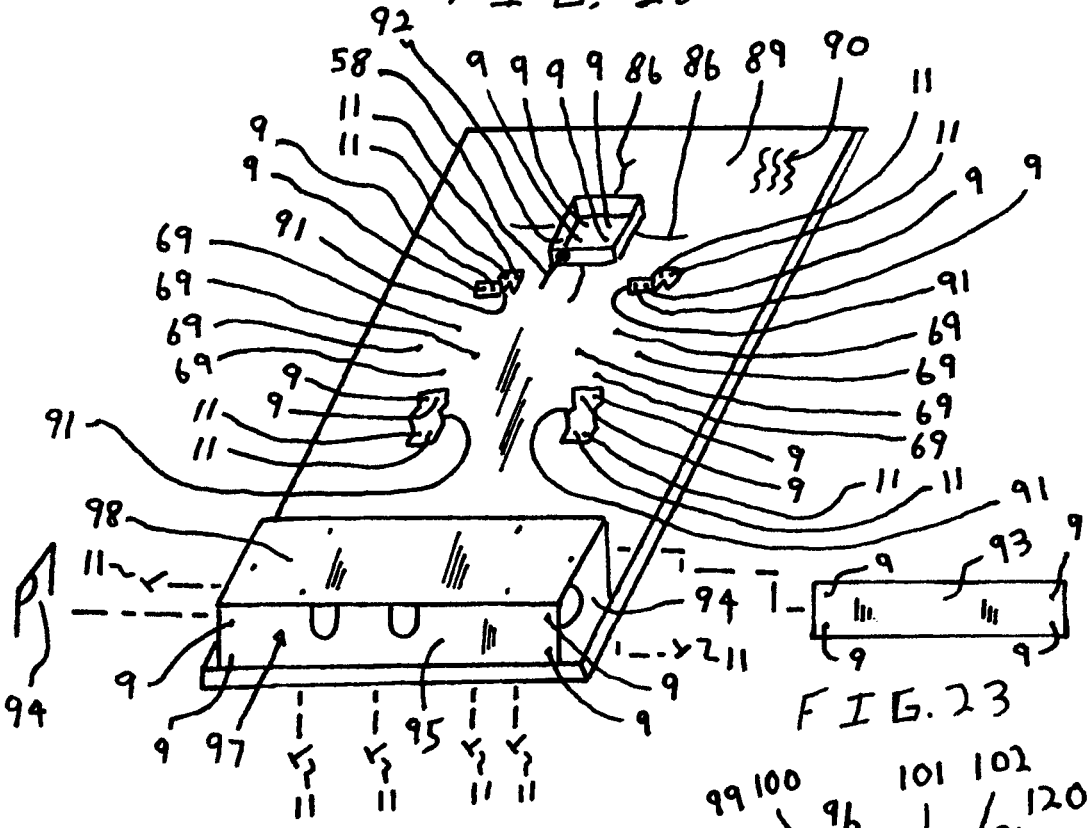
Figure 24:
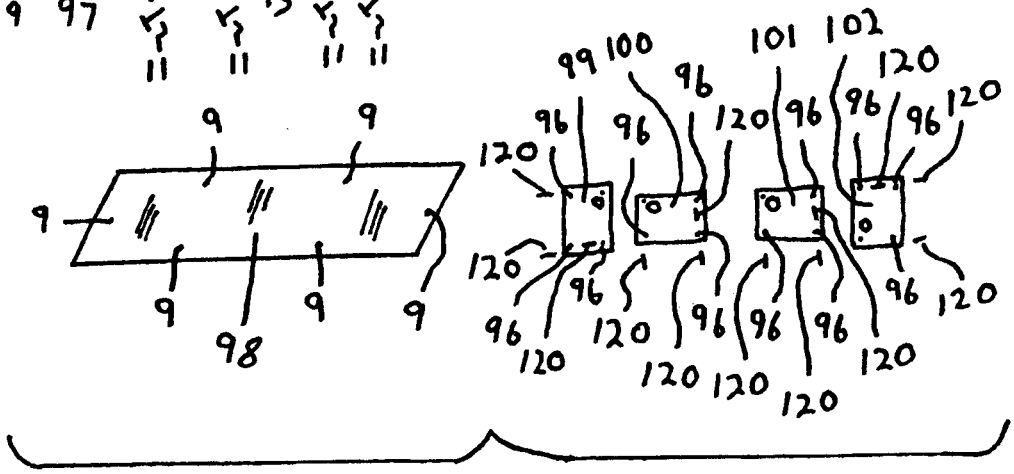
Figure 25:
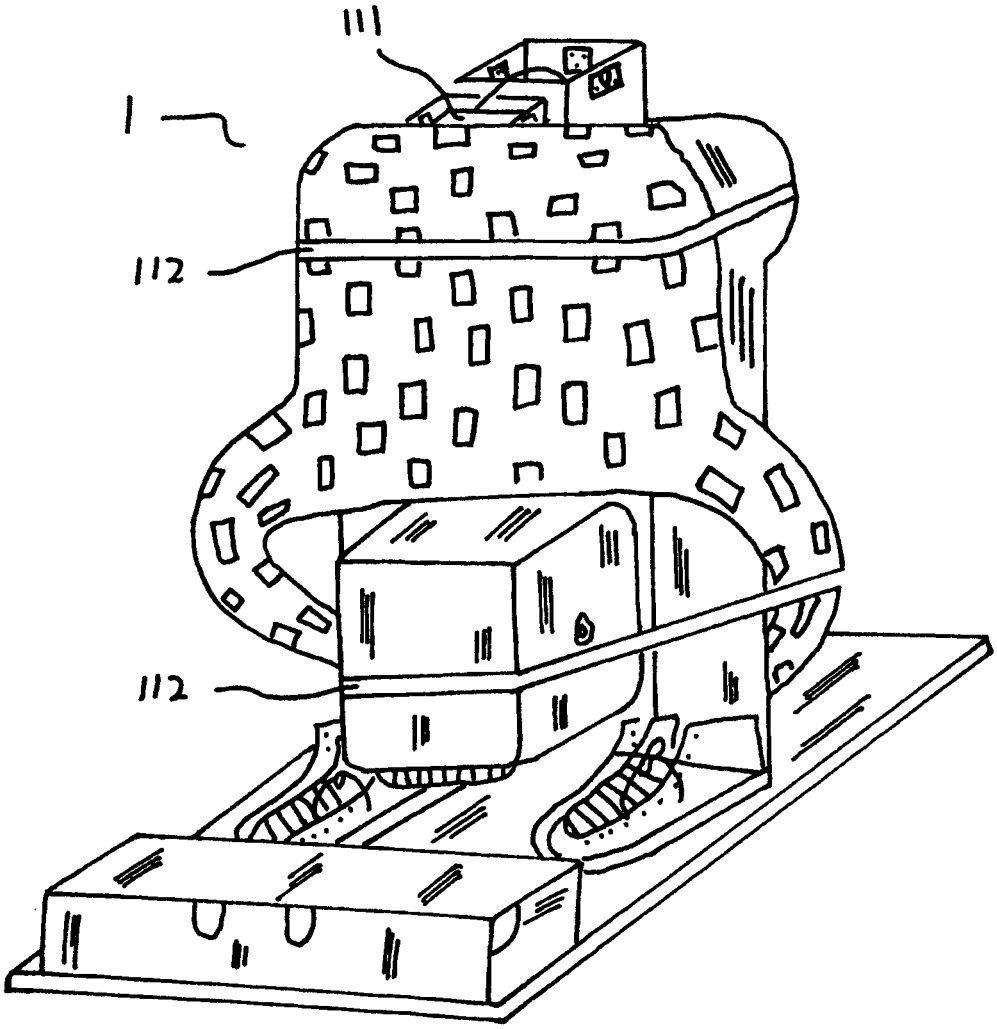
Figure 27:
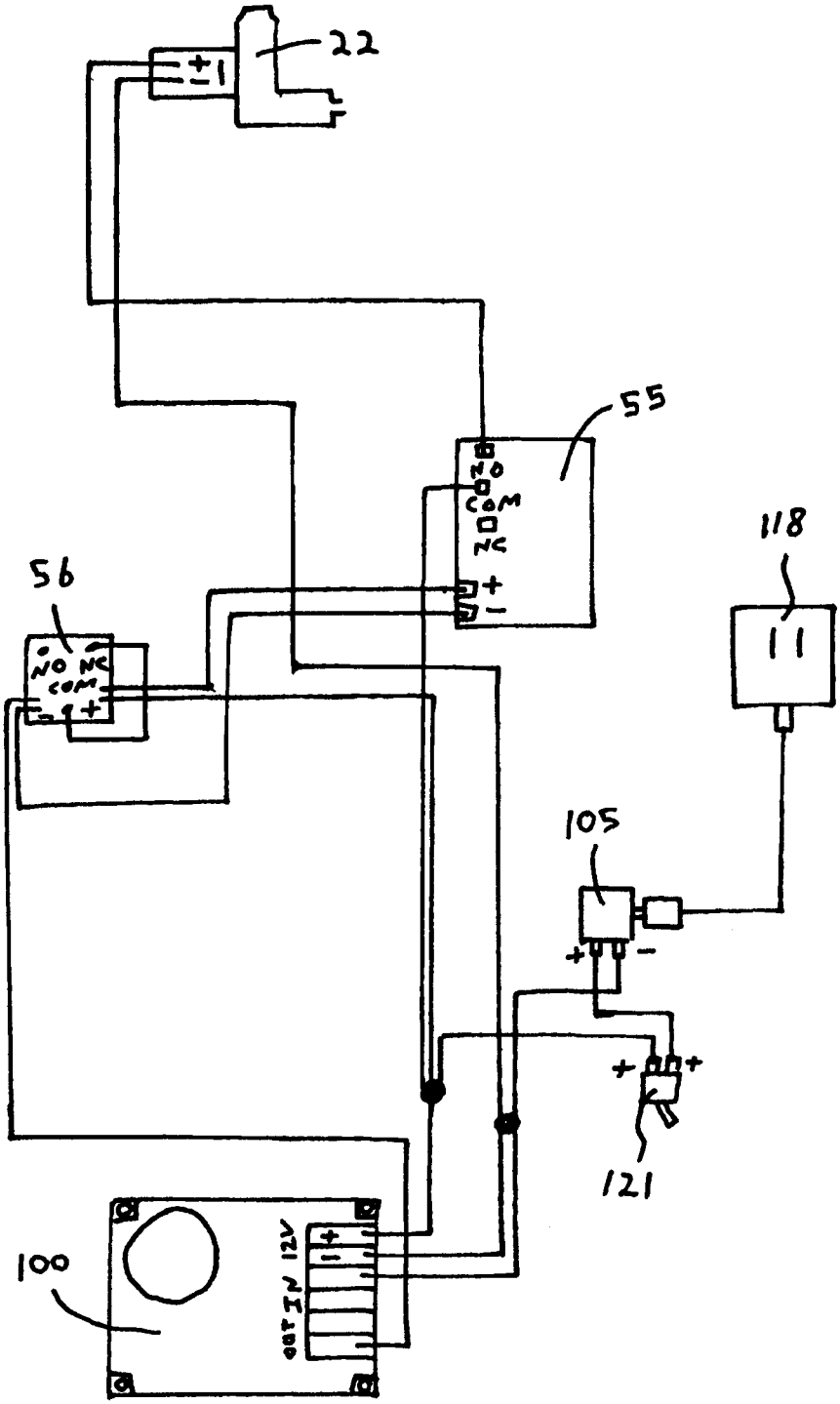
Figure 28:
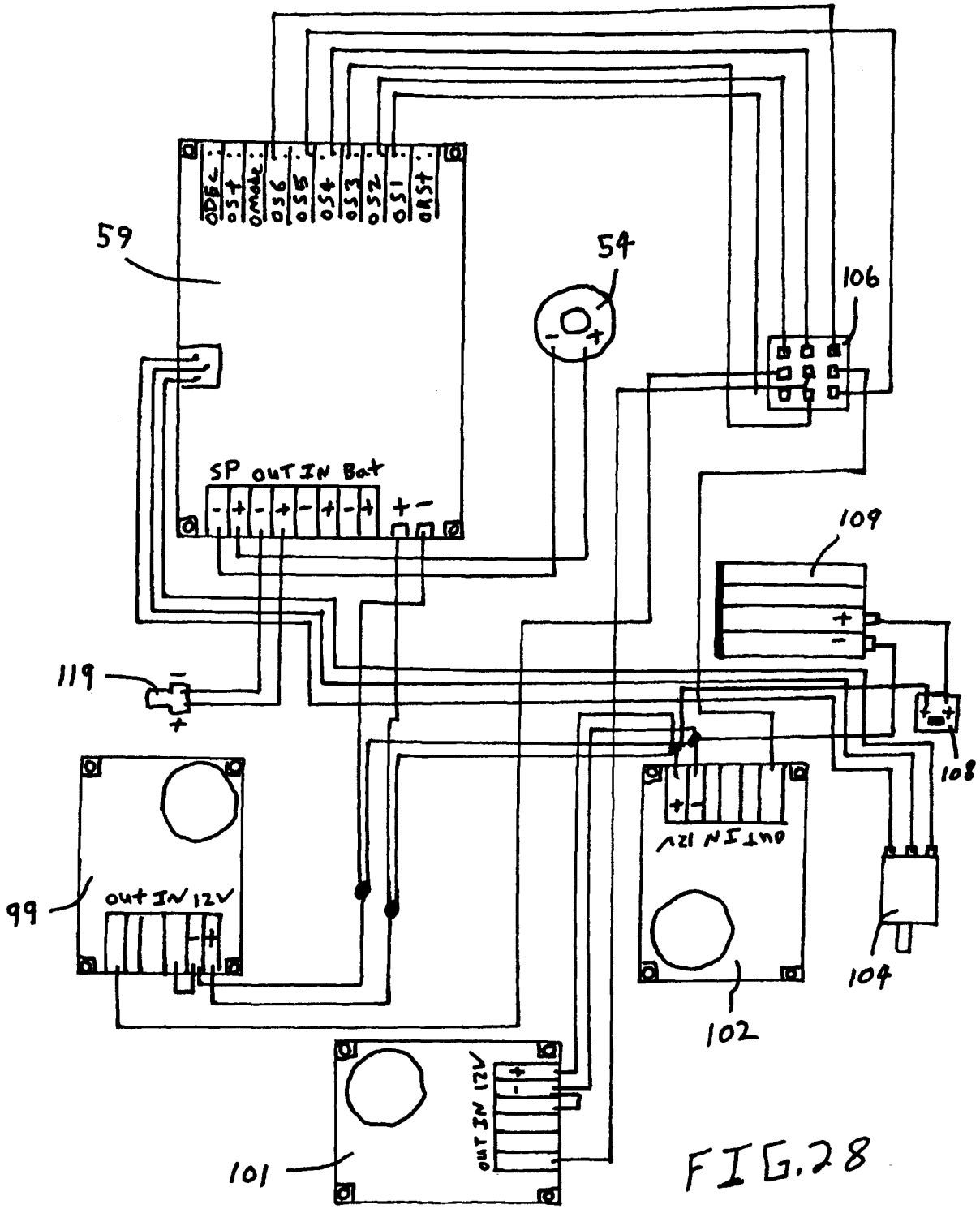

FIG. 10 shows a hinge assembly 42 which has a pair of upper reinforcement pieces 45 that are attached on the outside and the inside of the front upper body panel 35, (FIG. 8). The hinge assembly 42 has a pair of lower reinforcement pieces 44 that are attached on the outside and the inside of the front lower body panel 41, (FIG. 8). The hinge assembly 42 incorporates a set of six spacers, flat head bolts, lock washers, washers, and nuts 46 accomplishing the folding capabilities of the present invention.

Figure 11:
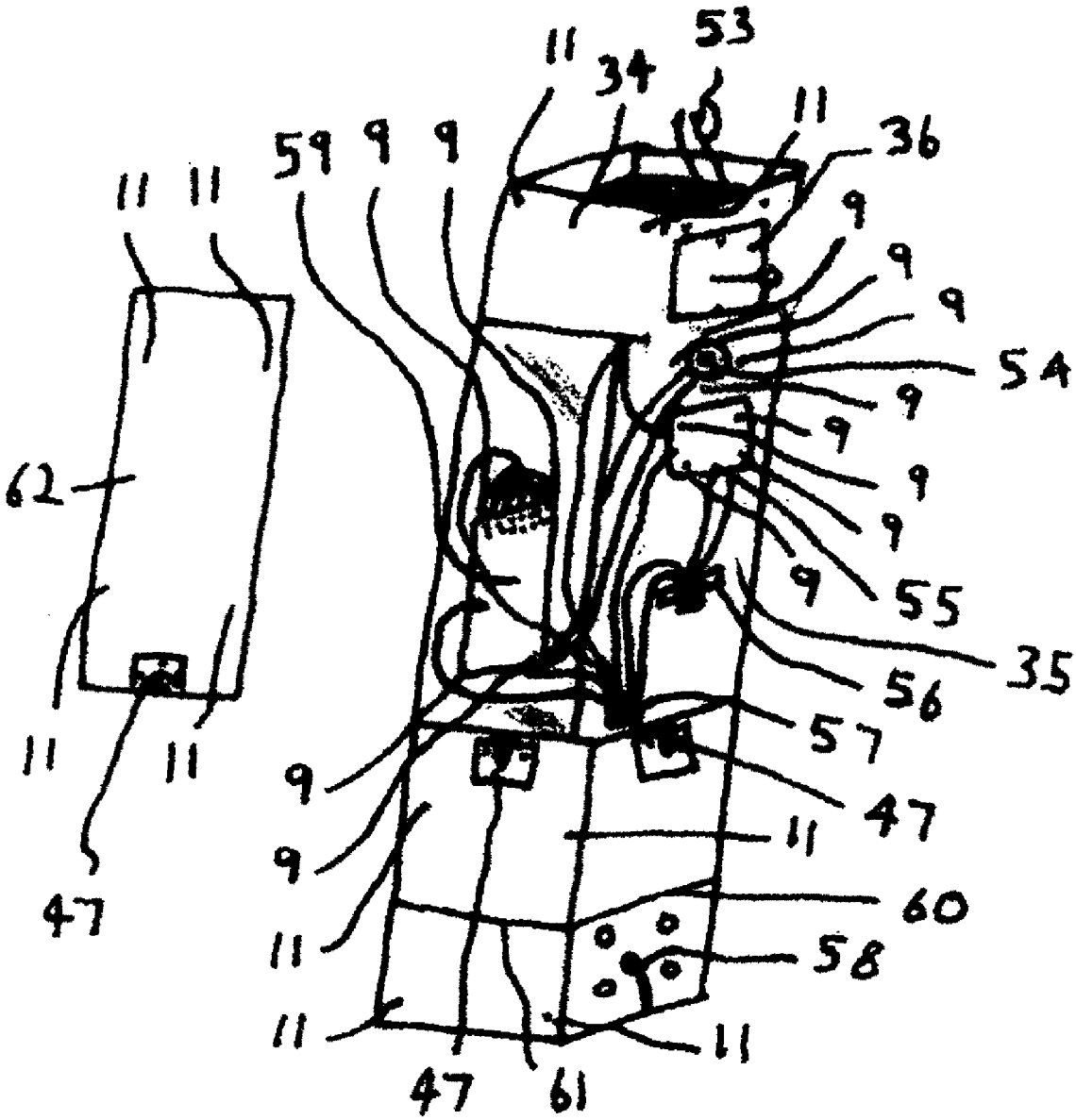
FIG. 11 is a perspective elevation of the rear of the present invention's body panels with a rear access panel opened and a right upper body panel removed in order to show the present invention's inner body panel's components which consist of a pair of right shoulder attachment parts, a right and a rear latch assembly, and a right leg assembly's attachment holes/bolts. The electrical components inside the body panels consist of a wiring harness with a clamp, a voice recorder, a 9 volt relay, a timer, and a speaker. The timer in conjunction with the motion sensor, power supply, and the electromagnetic valve (FIG. 27) permits the fluid to expel intermittently from the orifices on the tongue. The voice recorder and speaker in conjunction with three motion sensors, a message switch, and a power supply permits the present invention to say scary messages when it is approached from any three different angles.
Figure 22:
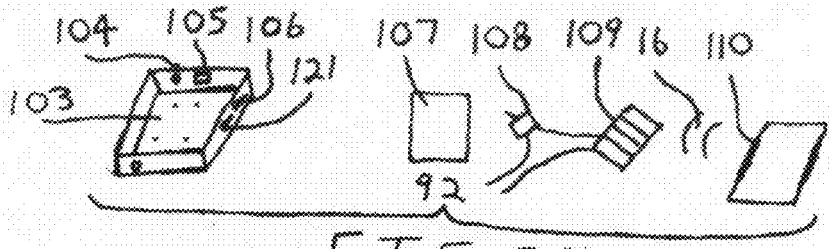
FIG. 22 is an exploded perspective elevation of a battery box assembly and its components which contains a cover that is tightened using a pair of shoe laces, a foam piece, an eight AA battery power supply with a holder, two on/off switches, an on/on switch to change messages, an ac/dc connector power supply for powering the valve motion sensor and a volume control knob and a volume control knob.
Figure 27:
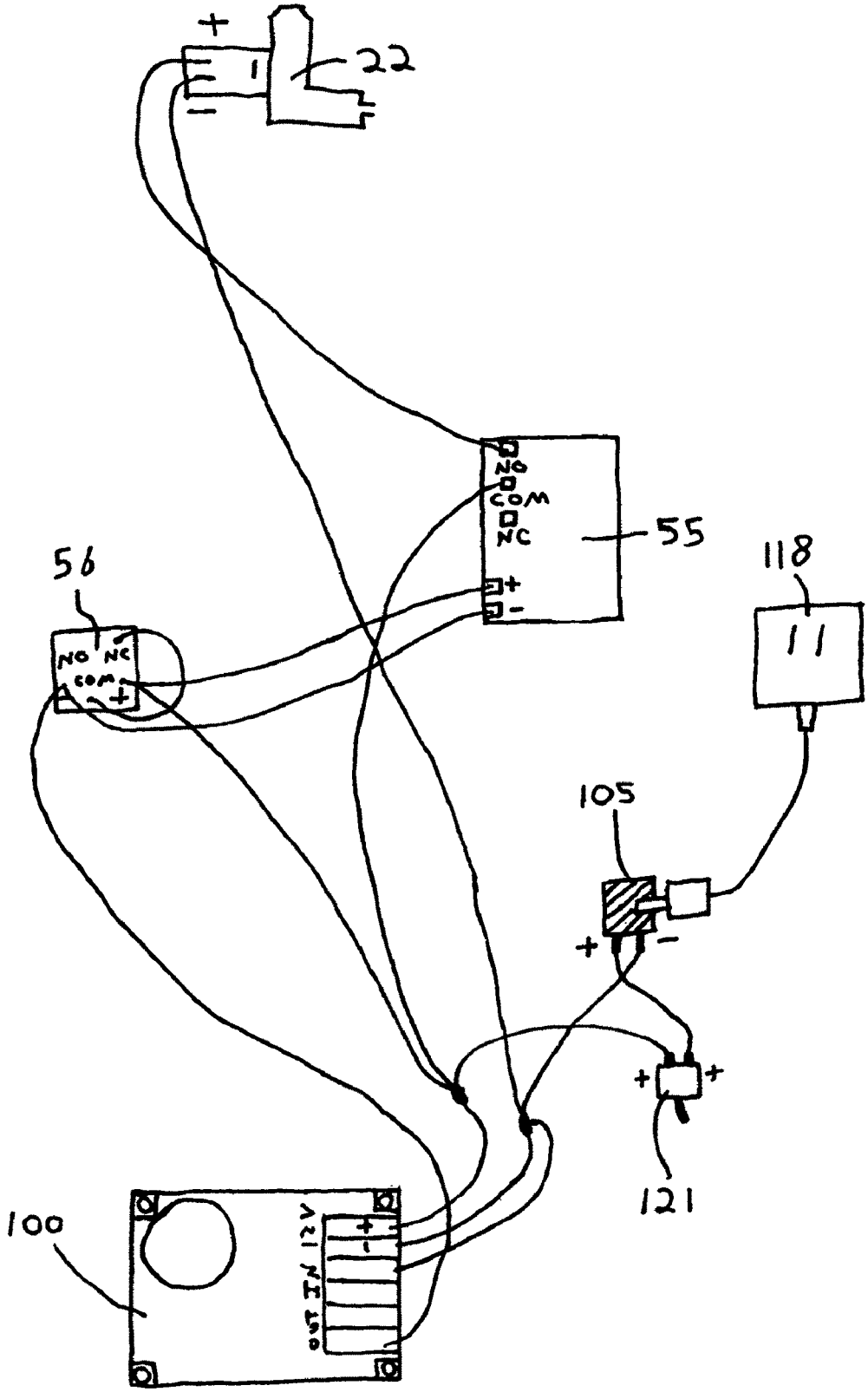
FIG. 27 is a wiring diagram for the electromagnetic valve which controls the throwing up action incorporating a 12 vdc ac/dc converter with power in connector, the on/off switch, a motion sensor, the 9 vdc relay, the timer, and the 12 VDC electromagnetic valve.
Figure 28:
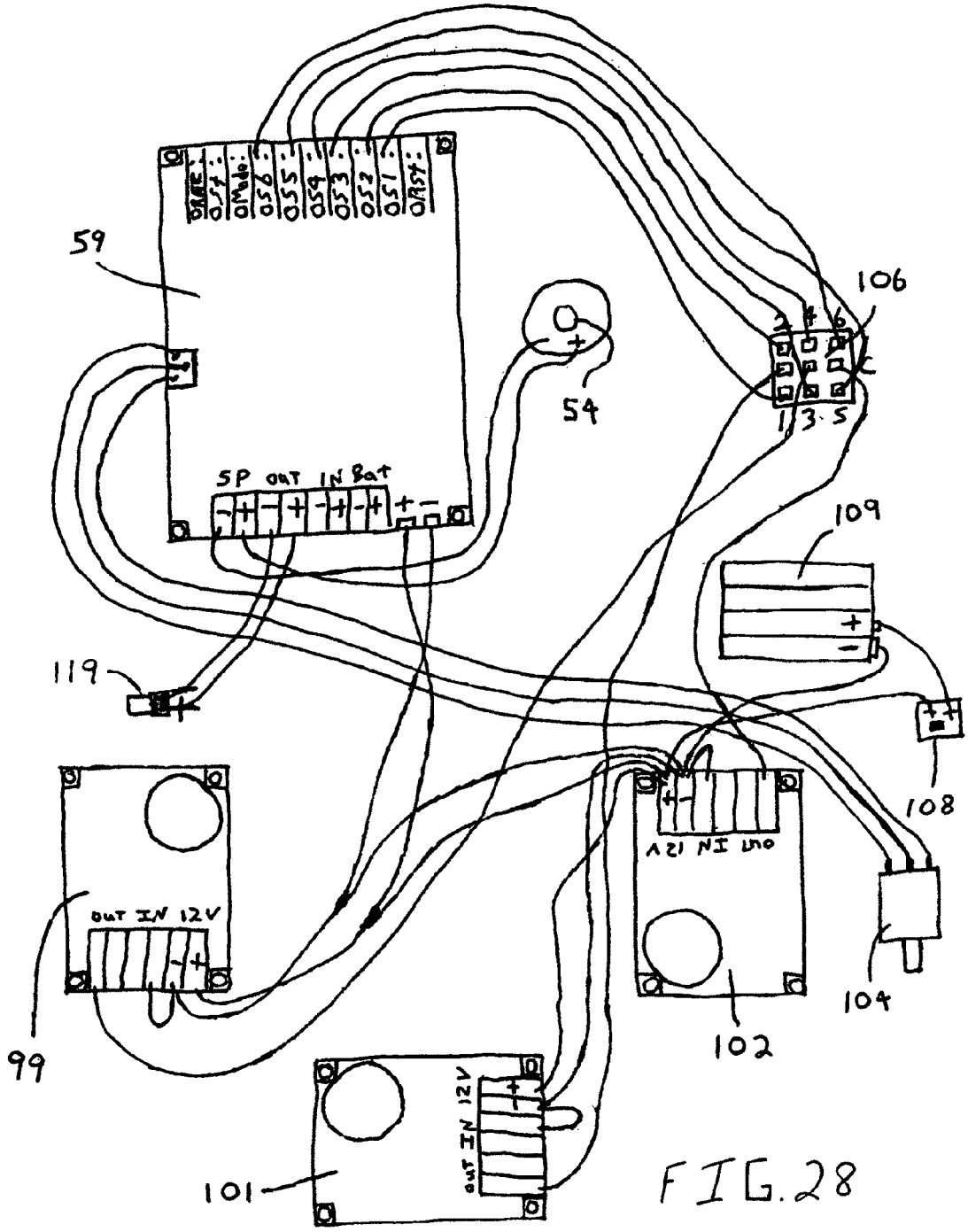
FIG. 28 is a wiring diagram for voice recordings which contain three sensors facing in different directions, a 12 volt battery pack with a set of eight AA batteries, a volume control, an 8 ohm speaker, the on/on switch, the on/off switch, and a 12 vdc voice recorder with an amp option. When the present invention is approached from different angles one of the multiple messages will play.
Figure 1:
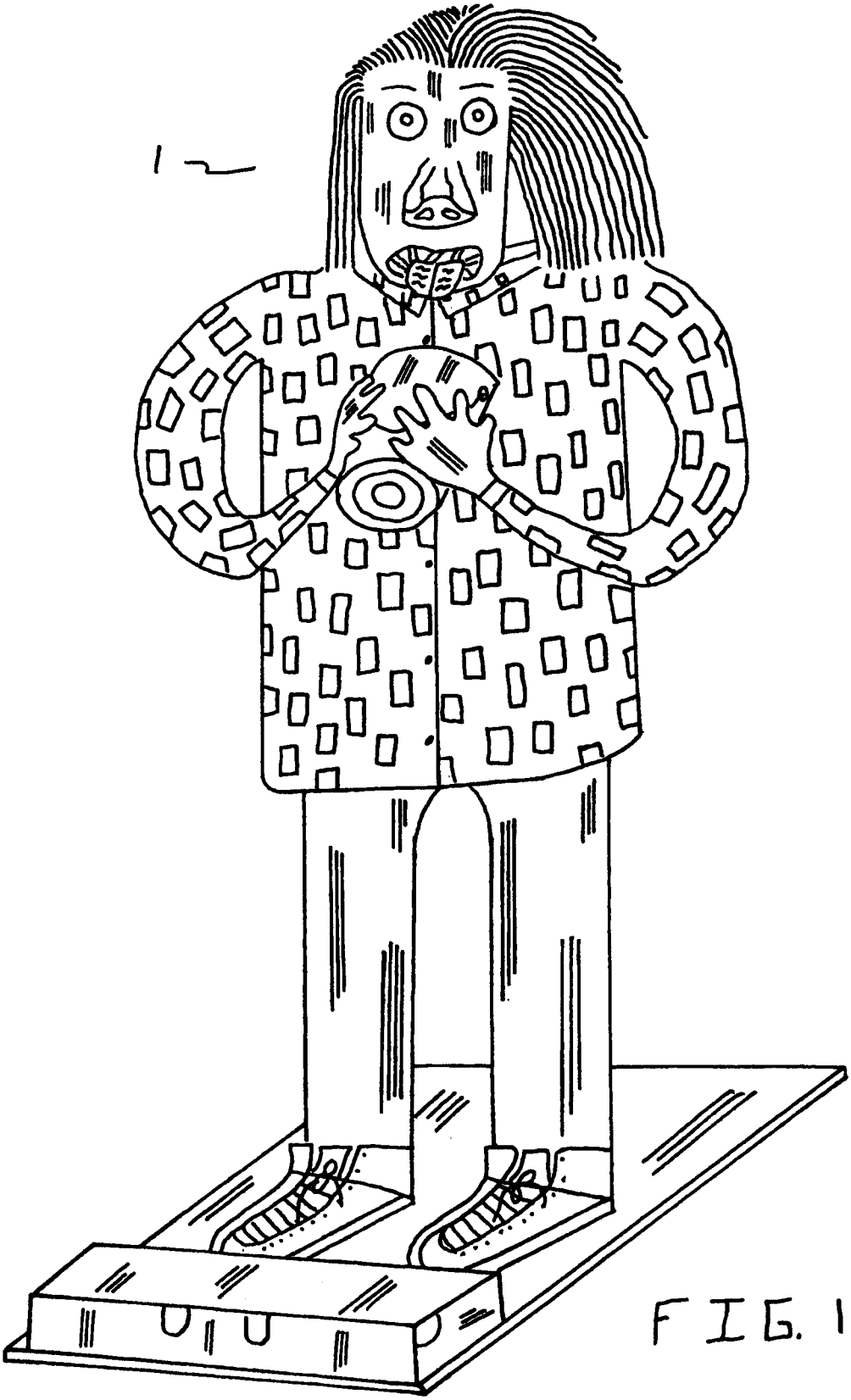
Figure 2:
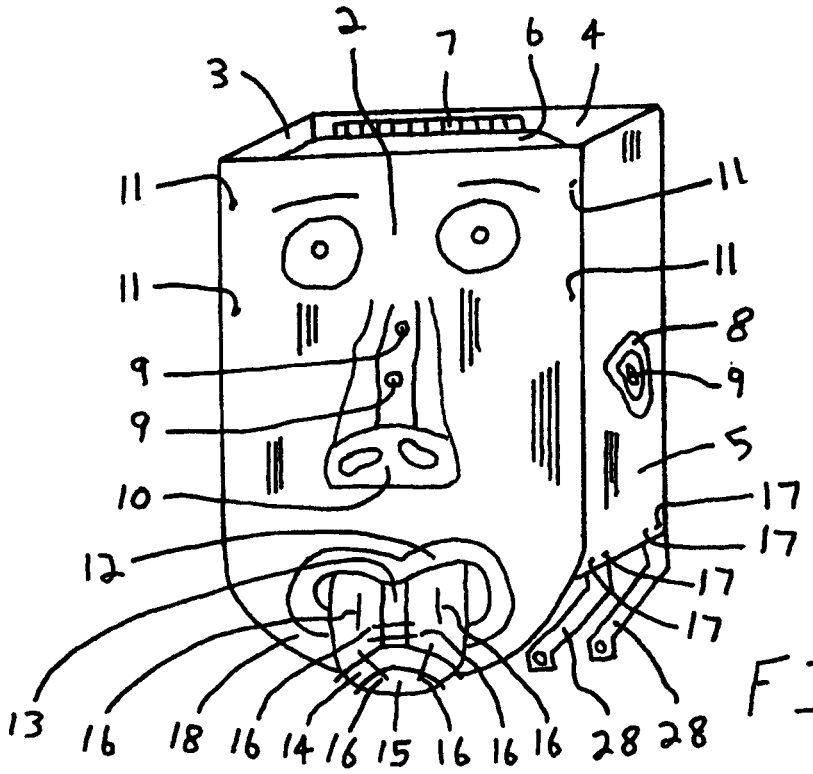
Figure 3:
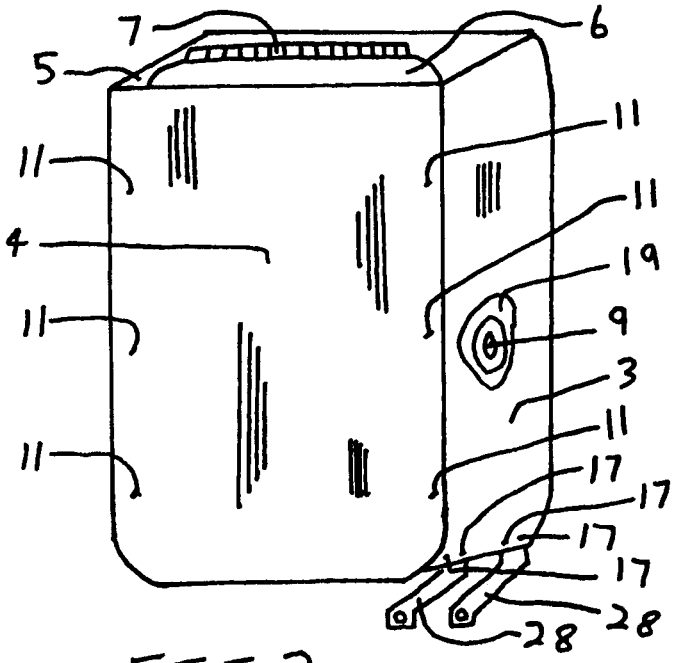
Figure 4:
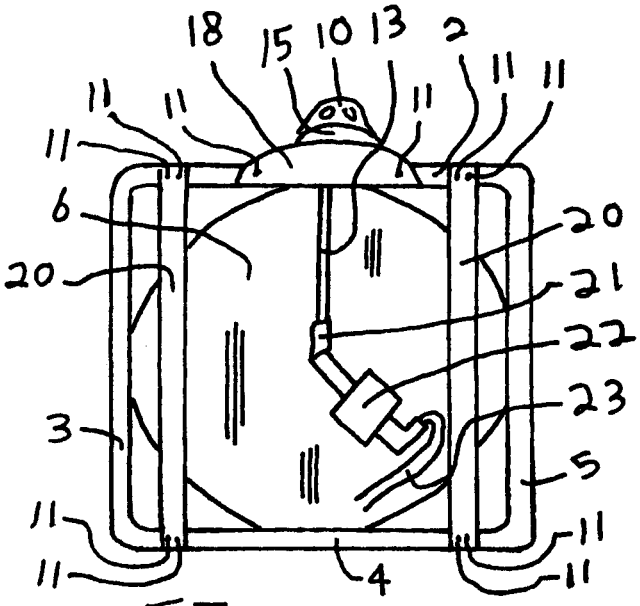
Figure 6:
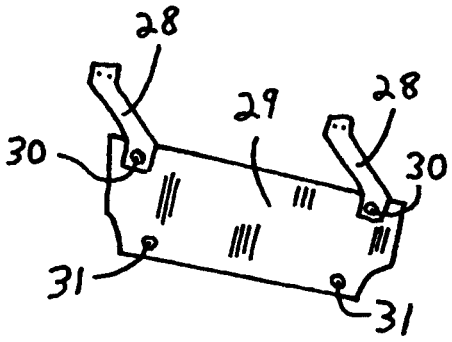
Figure 5:
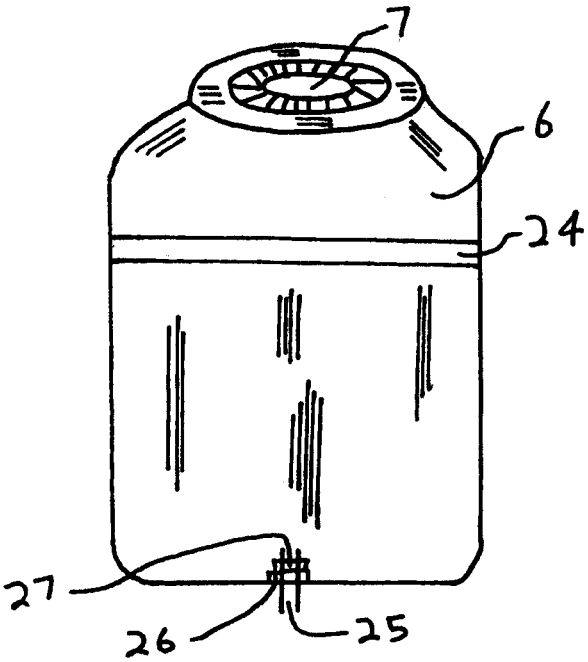
Figure 7:
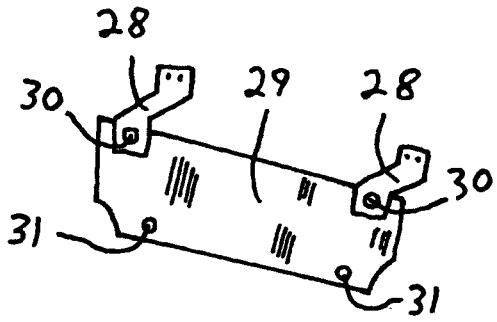

FIG. 11 shows a right hand rear view of the present invention consisting of a lower body panel 60, a lower body panel 61, the upper body panel 34, the upper body panel 35, with an access panel 62 removed and the right hand upper body panel 33, (FIG. 8) removed from the shoulder reinforcement piece 36 down thus showing the internal components of the present invention. The rear upper body panel 34 (FIG. 8) is attached to the body panels 33, (FIG. 8) using a pair of wood screws 11. The two latch assemblies 47 are attached to the right upper body panel 33, (FIG. 8), the right lower body panel 60, the access panel 62, and the rear lower body panel 61. There are a total of three latch assemblies (please see FIG. 8's description for details). The rear lower body panel 61 is attached to the left lower body panel 40, (FIG. 8) and the right lower body panel 60 using a set of four wood screws 11. A wiring harness 58 runs through the right lower body panel 60. The access panel 62 is used to access the internal components of the present invention and is attached to the body panels 33, (FIG. 8) using a set of four wood screws 11. 57 is a wiring harness clamp and two wood screws, which are attached to the inner front upper body panel 35. The wiring harness clamp 57 holds the wiring harness 58 in place when the invention 1, (FIG. 1) is folded in half or folded upright. 56 is a 9 vdc relay with a clamp and two screws which operates a timer 55 which both the timer 55 and the 9 vdc relay 56 are attached to the inner right upper body panel 33, (FIG. 8) using a set of six wood screws. The timer 55 and the 9 vdc relay cause the electromagnetic valve 22, (FIG. 4) to expel fluid from the fluid jug 6, (FIG. 4) intermittently when activated by a motion sensor 100 (FIG. 27). The wiring 53 connects to a 12 vdc ac/dc adapter 118 (FIG. 27) an on/off switch 120, (FIG. 27), a motion sensor 100, (FIG. 27), a 9 vdc relay 56, a timer 55, positive and negative wire connectors 23, (FIG. 4) and the electromagnetic valve 22, (FIG. 4). A voice recorder 59 is attached to the inner left upper body panel 33, using a set of four wood screws 9. The voice recorder 59 connects to a speaker 54. The speaker 54 is connected to the inner front upper body panel 35 using a set of four wood screws 9. The voice recorder 59 is connected to a set of motion sensors 99,101 and 102, (FIG. 24) a volume control 104, and an on/on switch 106 (FIG. 22). The on/on switch controls what three different messages will play. The voice recorder 59 has an amp option 119 (FIG. 28).

Figure 12:
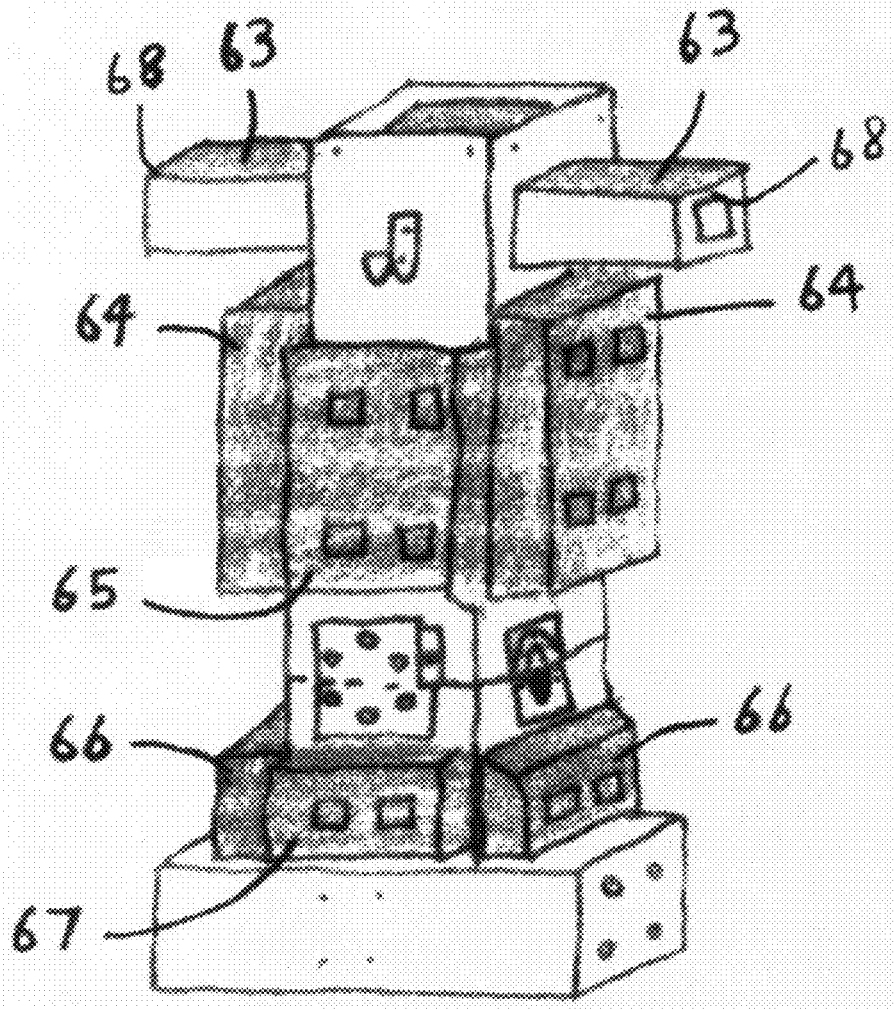
FIG. 12 is a perspective elevation of a front left hand view of the assembled body panels with a body slide bracket, a hip assembly, a right and left shoulder assembly, a left latch assembly, a hinge assembly, and a body panel foam with cutouts for accessing the latches. The hinge assembly permits the present invention to fold in half. The body slide bracket holds the bucket to the present invention which permits a removable bucket.

FIG. 12 shows a body foam assembly whereby giving the present invention a full appearance. 63 is a top right and a top left shoulder foam which is stapled to the top of the shoulders assemblies 68. 64 is an upper right and an upper left body foam which have four recessed areas in each one so they may be stapled to the left and the right upper body panels 33 (FIG. 8). 65 is a front upper body foam with four recessed areas so it may be stapled to the front upper body panel 35 (FIG. 8). 66 is a right and a left lower body foam and have two recessed areas in each one so they may be stapled to the lower right body panel 60 (FIG. 11) and lower left body panel 40 (FIG. 8). 67 is a front lower body foam and has two recessed areas so it may be stapled to the front lower body panel 41 (FIG. 8).

Figure 13:
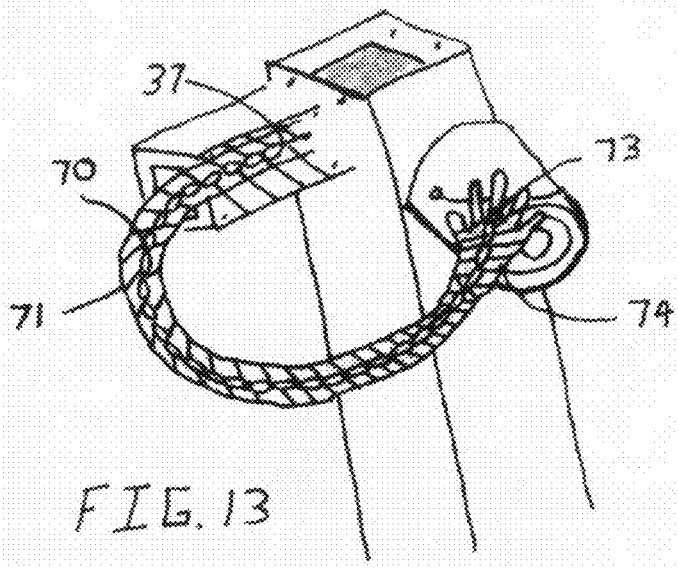
FIG. 13 is a cross sectional elevation of a right shoulder assembly, a right arm assembly, and a right glove assembly and how they connects to the right upper body panel and the bucket.

FIG. 13 shows a cross section of a right arm and a right glove which consists of a chain link 70 connected to an eye bolt 37, a pipe insulation 71, a glove stuffed with paper 74, and a hook 73 sewn inside the glove. This combination allows for the easiest disconnection of the hands and arms from the bucket. The added bonus is a realistic look as if the present invention is really holding the bucket to throw up into it.

Figure 14:
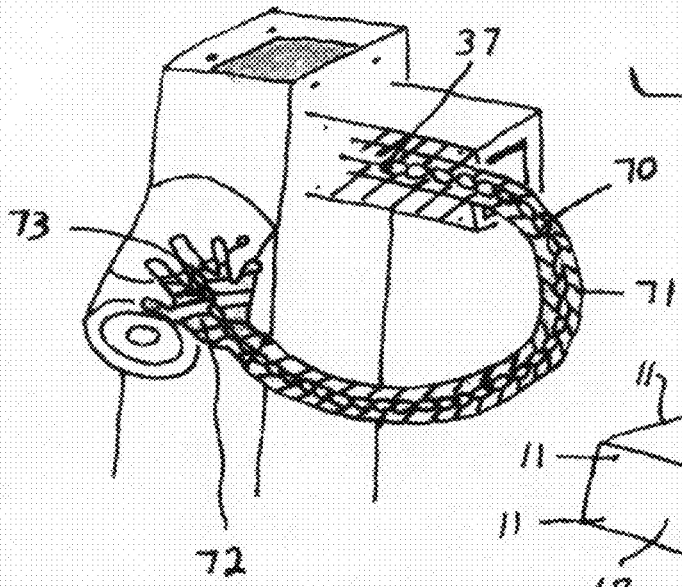
FIG. 14 is a cross sectional elevation of a left shoulder assembly, a left arm assembly, and a left glove with a hook and how they connect to the left upper body panel and the bucket.

FIG. 14 shows a cross section of a left arm and a left glove. Everything in FIG. 14 is identical to (FIG. 13) except a left glove 72.

Figure 15:
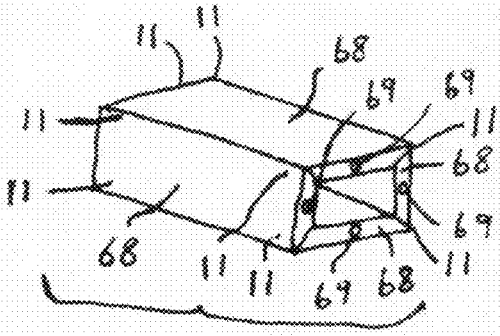
FIG. 15 is a close up elevation of the right shoulder assembly.

FIG. 15 shows a right shoulder assembly 68 that are attached together using a set of eight wood screws 11. The right shoulder assembly 68 have a set of four recessed holes drilled into it and is attached to the right upper body panel 33, (FIG. 11), and shoulder reinforcement piece 36, (FIG. 11) using a set of four wood screws 69

Figure 16:
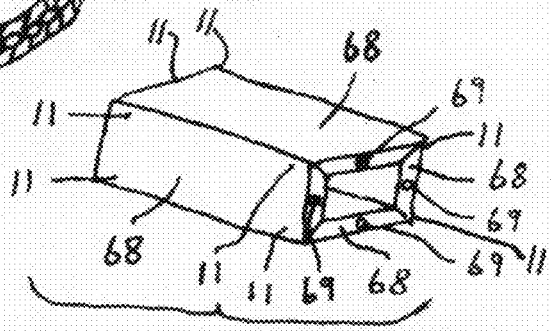
FIG. 16 is a close up elevation of the left shoulder assembly.

FIG. 16 shows a left shoulder assembly 68, a set of eight wood screws 11, and a set of four wood screws 69. FIG. 16 is identical to (FIG. 15) the only difference is that FIG. 16's parts are attached to the left upper body panel 33 (FIG. 8), and reinforcement piece 36, (FIG. 8).

Figure 17:
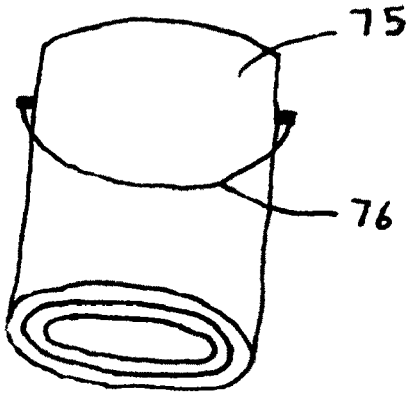
FIG. 17 is a perspective elevation of the front of a bucket with a handle. The handle permits the hands with hooks (FIG. 13 & FIG. 14) to be removable.

FIG. 17 shows a front view of the bucket 75 and a handle 76.

Figure 18:
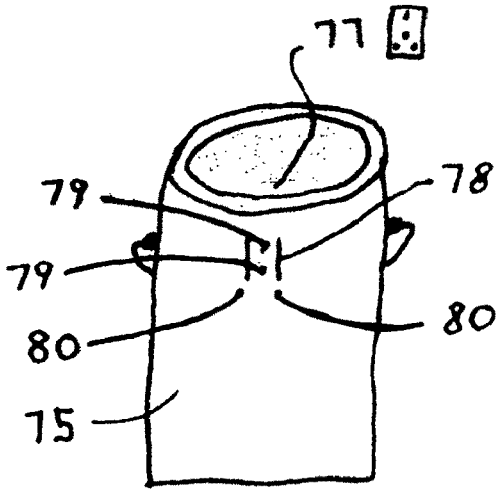
FIG. 18 is a perspective elevation of the rear of the bucket and it's handle showing the bucket's slide bracket and the bucket's slide bracket support, which the support is located inside the bucket.

FIG. 18 shows a rear view of the bucket 75 showing a bucket bracket 78, a reinforcement piece 77, a screw, a lockwasher, a washer, and a nut 79, and a machine screw, a washer, a lockwasher, a washer, and a nut 80. All these parts have silicone between them to prevent leaks.

Figure 19:
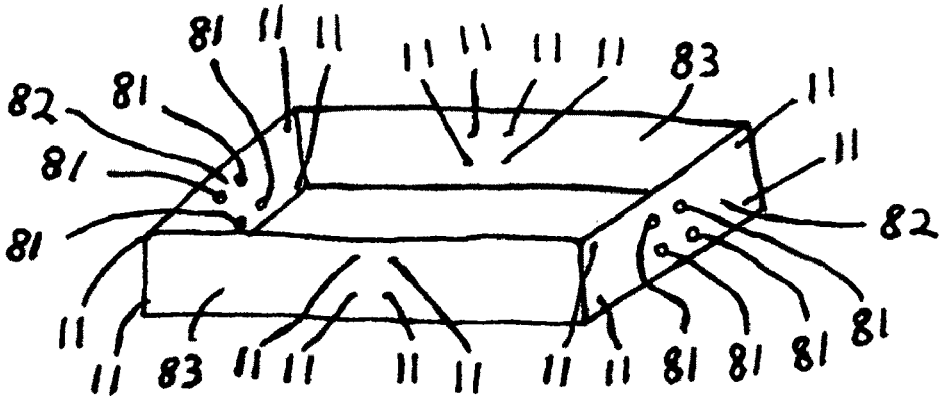
FIG. 19 is a perspective elevation of a hip assembly and it's provisional holes for the attachment to a pair of leg assemblies and a body panel assembly.

FIG. 19 represents a hip assembly which connects to a pair of legs, (FIG. 20 & FIG. 21) using a set of eight bolts, sixteen washers and eight nuts 81. A front hip panel 83 connects to a left hip panel 82 and a right hip panel 82 using a set of four wood screws 11. A rear hip panel 83 connects to the left hip panel 82 and the right hip panel 82 using a set of four wood screws 11. A front hip panel 83 connects to the front lower body panel 41 (FIG. 8) using a set of four wood screws 11. The rear hip panel 83 connects to the lower rear body panel 61 (FIG. 11) using a set of four wood screws 11. The purpose of the hip assembly is to connect the body panels to the leg assemblies.

Figure 20:
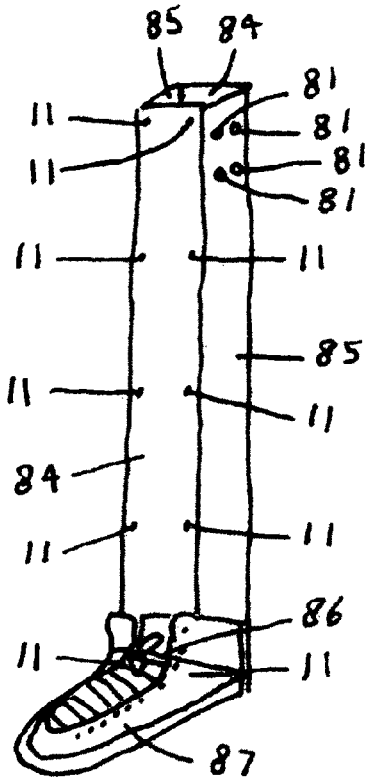
FIG. 20 is a perspective elevation of a right leg assembly and a shoe showing the right leg assembly's provisional holes for attachment to the hip assembly and the body panel assembly.

FIG. 20 shows a right leg assembly consisting of a front leg panel 84 which is attached to a left leg panel 85 and a right leg panel 85 using a set of ten wood screws 11. A rear leg panel 84 is attached to the left leg panel 85 and the right leg panel 85 exactly the same as the front leg panel 84 using a set of ten wood screws 11. The leg panel 85 is attached to the right lower body panel 60, (FIG. 11) using a set of four bolts, eight washers and four nuts 81. 87 is a right running shoe with a lace 86 tied around the leg panels 84 and 85 and under a rear leg reinforcement piece 91, (FIG. 23).

Figure 21:
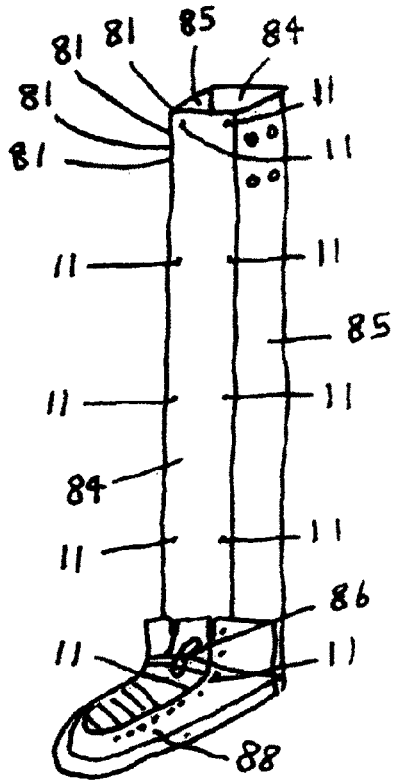
FIG. 21 is a perspective elevation of a left leg assembly and a shoe showing the left leg assembly's provisional holes for attachment to the hip assembly and the body panel assembly.

FIG. 21 shows a left leg assembly and is identical to (FIG. 18) except it has a left hand running show 88.

FIG. 22 is an exploded view of a battery box assembly 92, (FIG. 23) and has a square battery box 103 made with a bottom and four equal sides using a set of twelve nails. The battery box 103 contains a volume control 104, an ac/dc plug in connector 105, an on/off switch 121 an on/on switch 106, a battery cushion foam 107, a battery pack 109 with an on/off switch 108. The on/off switch 108 is connected to the battery box 103 using a pair of heavy duty wire twists 16 that go through four holes drilled into the side of the battery box 103. The battery box cover 110 covers the battery box components and is held in place using two shoe laces 86, (FIG. 23) which are located under the battery box assembly 92, (FIG. 23).

Figure 23:
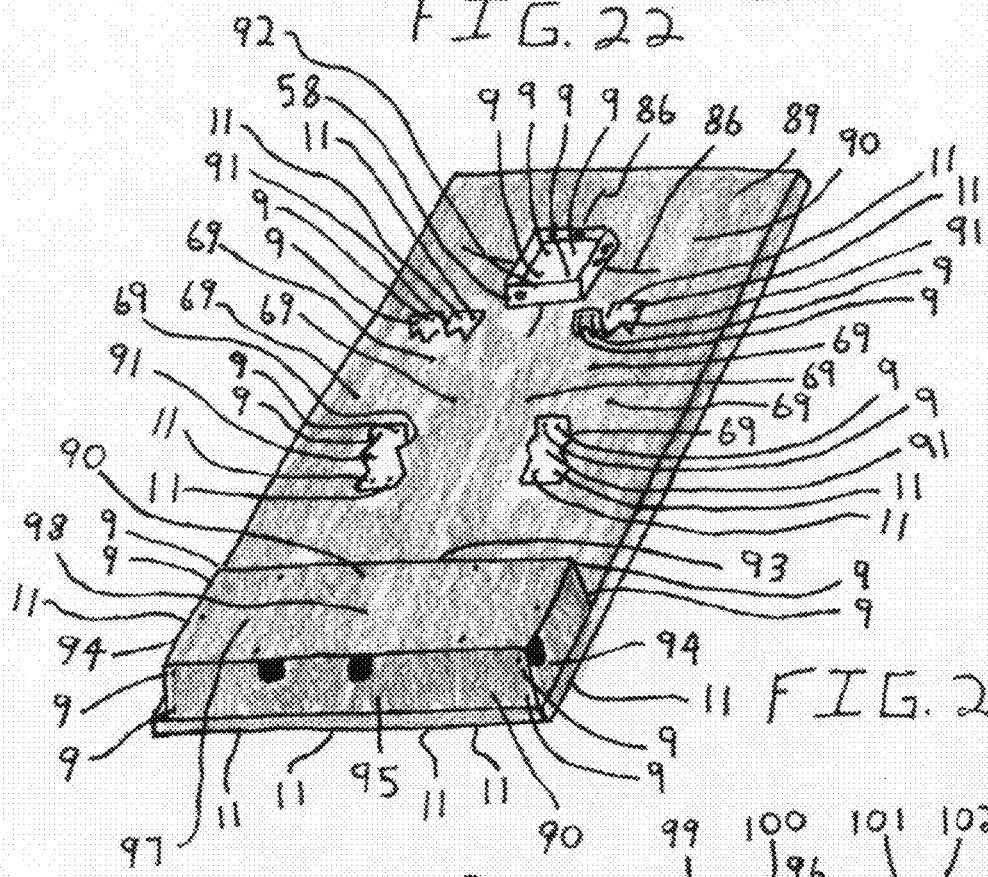
FIG. 23 is a perspective elevation of a stabilization board with a moss mat covering, a wiring harness, a motion sensor box, the battery box, right leg & left leg reinforcement pieces. The stabilization board keeps the present invention stable.

FIG. 23 shows a stabilization board 89 with a moss mat 90 which is located at the lowest part of the present invention, and contains a motion sensor box assembly with components 97, the battery box with components 92, and is responsible for keeping the present invention upright during the weight shift from liquid leaving the fluid jug 6, (FIG. 2) and spilling into the bucket 75, (FIG. 17). 91 is a set of four reinforcements for the right and left leg assemblies (FIG. 20 & FIG. 21) respectively and are attached to the stabilization board 89 each using a pair of wood screws 11. The four leg reinforcements 91 connect to the bottom of the right leg and the left leg assemblies, (FIG. 20 & FIG. 21) using a pair of wood screws 9 each. 69 is a set of eight wood screws that hold the right leg and the left leg assemblies (FIG. 20 & FIG. 21) to the stabilization board 89. The motion sensor box 97 has four panels which consist of a left & a right panel 94 with two cutouts each for a right motion sensor 99 and a left motion sensor 102, (FIG. 24), a rear panel 93, front panel 95 with four cutouts for a pair of motion sensors 100 and 101. The front panel 95 of the motion sensor box 97 is connected to the left and right panels 94 using a set of four wood screws 9. The rear panel 93 of the motion sensor box 97 is attached to the left and right panels 94 using a set of four wood screws 9. Motion sensor box 97 is attached to the front of the stabilization board 89 using a total of six wood screws 11 screwed through the bottom of the stabilization board 89 with a pair of screws in the front panel 95, a pair of screws in the rear panel 93, and a screw in the right and left panels 94. Located on the back part of the stabilization board 89 is the battery box assembly 92 with a pair of shoe laces 86 and is attached to the stabilization board 89 using a set of four wood screws 9.

Figure 24:
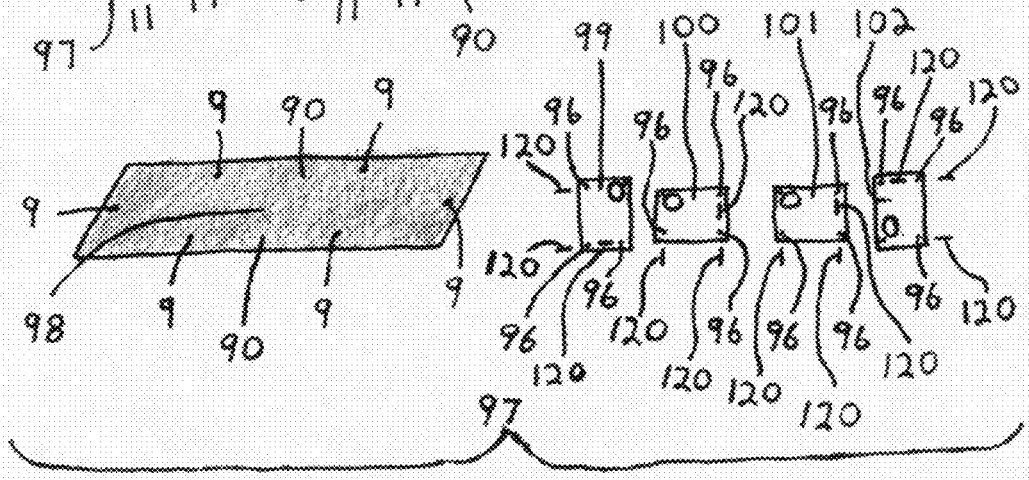
FIG. 24 is an exploded perspective elevation of a motion sensor box cover and it's internal components.

FIG. 24 shows a cover 98 and the inside of the motion sensor box, 97, (FIG. 23). The motion sensor box houses four motion sensors, specifically a right motion sensor 99, a front right motion sensor 100, a front left motion sensor 101, and a left motion sensor 102. All of these motion sensors are placed inside the motion sensor box 97 on a 45 degree angle and are attached to the stabilization board 89 and the motion sensor box's front and side panels 95, and 94 using a set of three wood screws 96, and three spacers 120, for each motion sensor. A motion sensor box access lid 98 is attached to the top of the motion sensor box front panel 95, the rear panel 93, and the right panel 93 using a set of six wood screws 9.

Figure 25:
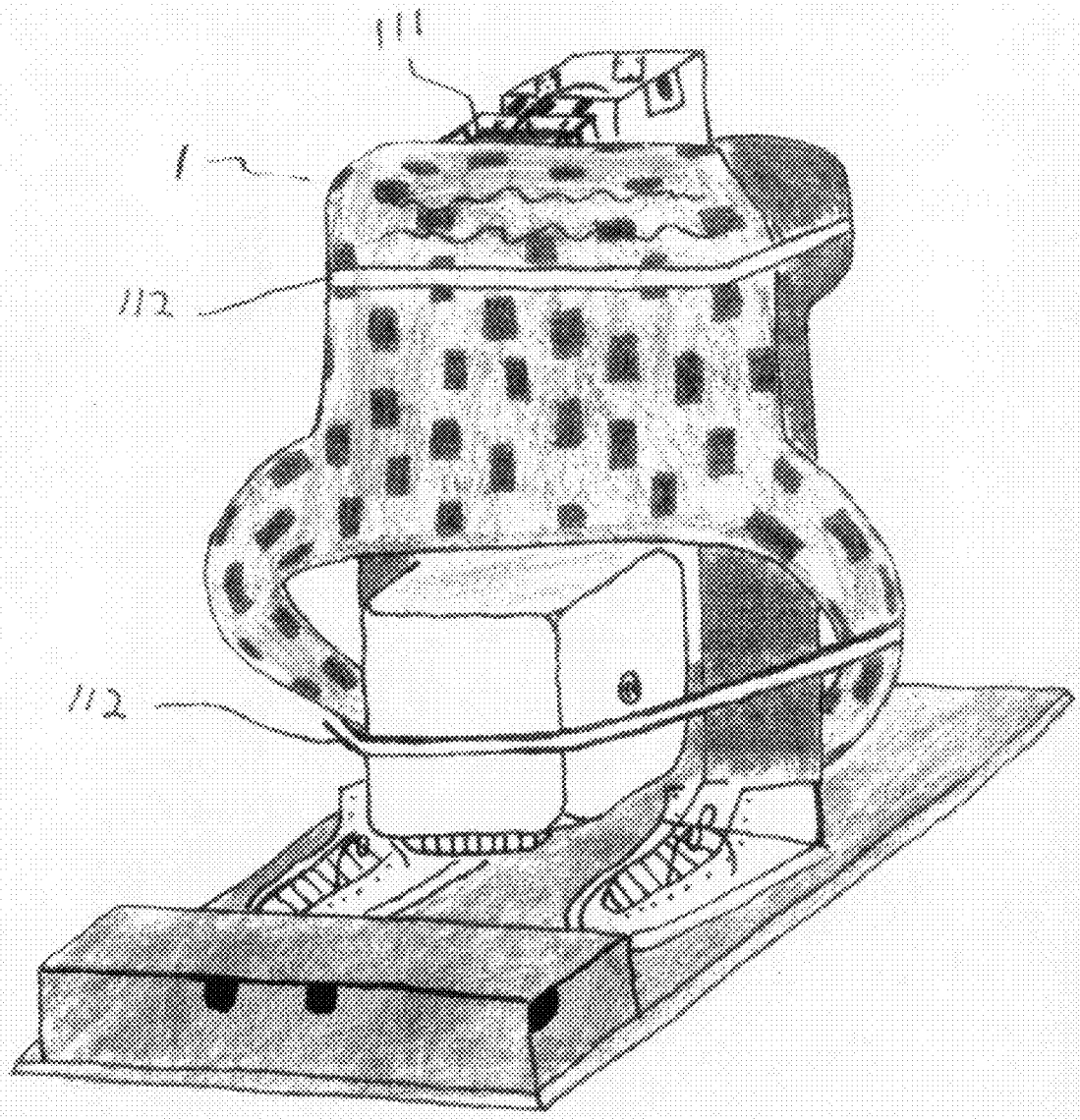
FIG. 25 is a perspective elevation of the present invention folded in half whereby showing an inside component cover and a pair of straps holding the present invention together.

FIG. 25 shows the assembled Halloween novelty invention 1, in a folded position. 111 is a foam insert which protects and covers the wiring and inner body assembly components (FIG. 8). 112 is a set of straps used to secure the present invention for shipping or storage.

FIG. 26A shows a wig 113 which covers the top of the fluid jug 6, (FIG. 2) and gives the present invention a head of hair.

FIG. 26B shows a neck fabric 116 that has four magnets 117 sewn into it's upper part. The magnets 117 connect and disconnect form the right and the left upper neck brackets 28 (FIG. 2 & FIG. 3). The magnets make it very easy to access the electromagnetic valve 22, (FIG. 4) so the tube 13, (FIG. 4) and the positive/negative wire connectors 23, (FIG. 4) can be disconnected when the user wishes to remove the fluid jug 6, (FIG. 2).

FIG. 26C Shows a flannel shirt 115 which covers up the body panels (FIG. 11) and arms (FIG. 13 & FIG. 14).

FIG. 26D Shows a pair of sweat pants 114 that cover the hips assembly (FIG. 19) and the right and left leg assemblies (FIG. 20 & FIG. 21)

FIG. 26E Shows a right running shoe 87 and a lace 86 and a left running shoe and a lace 88 & 86 respectively.

FIG. 27 Shows an electrical diagram for a throwing up system consisting of a 12 vdc ac/dc power converter 118 that plugs into a house wall socket, an on/off switch 121 which powers up a motion sensor 100, a 9 volt dc relay 56, a timer 55 which finally sends an intermittent power supply to the electromagnetic valve 22. When all that occurs the Halloween novelty invention will throw up intermittently into a bucket 75 (FIG. 17). The throwing up will occur as long as someone stands in front of the present invention. This design was used so the present invention's bucket will not fill up to fast. Actually, it takes a fairly long time for the Halloween novelty invention to fill up the bucket and the fluid jug to become empty even if someone stood in front for a long period of time. This was accomplished first using a fairly large water supply which is three liters and second that the present invention incorporates a timer so it is not constantly throwing up and in turn made the throwing up much more interesting.

FIG. 28 shows an electrical diagram for a voice recorder 59, a speaker 54, a volume control 104, an amp option 119 is A 12 volt Battery pack 109 uses eight double AA batteries and has an on/off switch 108 that powers up the right sensor 99, the left front sensor 101, the right sensor 102 and the voice recorder 59. If anybody passes one of these motion sensors one of three scary messages will play. Even if someone walks in front of a different motion sensor the first one they passed by will finish its message before it starts another. There is a special on/on message switch 106 and if the operator flips the switch they will hear three other scary messages depending on which motion sensor they pass by.

Message 1, Sensor front left: (A woman screaming with a man laughing in the background); "THIS IS WHAT YOU GET WHEN YOU STAND IN FRONT OF THE REGURGITATOR, AAAAAAAAAA" (throw up noises at the end)

Message 2, Sensor front left: (A strange yelp in background at the beginning with an organ playing until the last few seconds). (gurgling noises), "What is this? (more gurgling/moaning noises and howling in background at the end of the message).

Message 3, Sensor right: (A strange creature moaning in the background) "You know what this is! You know what this is! You know WHAT THIS IS, YOUR NIGHTMARE" (a strange moaning at the end of the message)

Message 4, Sensor right: (A strange creature moaning in the background) "It's alright, It's alright, I'm not going to hurt you, ah ah ahahahah, I'm not going to hurt you little one, I'm not going to hurt you, ah ah ahahahah."

Message 5, Sensor left: (An orchestra of very scary music in the background) "Did you see it?" Did you SEE it?" (A strange inhaling noise) "DID you SEE IT?" (very strange moaning noises at the end of message)

Message 6, Sensor left: (Strange human yelping noises in the background) "Do you know what that is?" "Do you here that?" "Do you know what she sees?" "DO YOU?" (crazy laughing then strange inhaling noises at end of message).

All background noises used are from Trade Mark;

HORROR SOUNDS OF THE NIGHT #5023 Copyright; Topstone,

Danbury, Conn. 06810 (made in Taiwan)

Electromagnetic Valve Jefferson Solenoid Valves (J)

CATALOG N': 2026BA302T,

SIZE: ¼" NPT

COIL: 12V/DC

SERIES: OM30337 quility system. ISO 9001 certified

Optional food coloring: Red, blue, green, yellow

Registered: BADIA

Badia Spices, Inc.

PO Box 226497, Miami, Fla. 33172-6497

Wig: Vampire 26" Long!

Trade Mark: PMG Halloween

Trade Mark: CSS (Creative Seasonal Solutions)

Copyright: 2005 Distributed by The Paper Magic Group, Inc.

Scranton, Pa. 18501

A CSS Industries, Inc. Company All Rights Reserved,

Made In China.

Latches: (Draw Catch): Draw Catch, Designer Basics, Hobby Hardware

Registered: IVES by SCHLAGE

Registered: (IR) SCHLAGE, Security & Safety Products

Part #: Brass Plated, made in China

Copyright: H. B. IVES nEW hAVEN, Conn. 06511

(Note; a higher quility latch should be used these needed to be modified to work correctly)

Voice Recorder: MAXX TRONIC

Model: MX 023 Digital Voice Recording 90 sec. (6 ch. programmable)

Serial number: 140607

Power supply: 12 Vdc./max. 150 mA

Audio power amplifier built-in on0board,

Output power: 720 mW, RL=4 ohms.

Maximum record: 6 messages.

100-year message retention (no battery backup and power supply).

100,000 record cycles (typical)

Made in Thailand.

Cyclic Timer: Adjustable on/off UK191

Manufactured by: Cana Kit Corporation (Unikit is a division of Cana Kit Corporation)

#121-3823 Hennin Drive

Burnaby, BC, V5C 6P3, Canada

Distributed in Canada by: Circuit-Test Electronics Ltd.

2060 Rosser Avenue

Burnaby, BC, V5C 5Y1, Canada

Copyright: 2001 Cana Kit Corporation All rights reserved.

Mini Relay: 9 VDC SPDT Mini Relay

Contacts rated: 12 A at 120 VAC/24 VDC

Registered: RadioShack 275-005

Nominal coil voltage: 9 VDC

Coil resistance: 500 ohm+−10%

Nominal coil current: 18 mA

Contact rating: 12 A at 120 VAC/24 VDC

Registered: RL

Custom manufactured in Taiwan for RadioShack Corp.,

Fort Worth, Tex. 76102

Motion Sensors (4): MAXX TRONIC.

Model: MX063 PIR SENSOR LIGHT.

Power Supply: 12 VDC.

Consumption: 50 mA max.

Delay Timer Off: From 5 seconds to 10 minutes.

Detecting The Human: 1 to 8 meters.

500 watts maximum output load.

Dimensions: 4.12×2.08 inches.

On-On Switch:

Miniature Bat Handle Toggle

Trademark: GC Electronics RoHS

1801 Morgan Street

Rockford, Ill. 61102-2690 USA

Part No. 35-024, (SA) (UL) listed 2n35

ON-ON

Rating: 5 A 125V AC, 28V DC, 2 A 250V AC 3PDT

Mounting Hole: 0.250"

Manufactured in Taiwan

Copyright: 2006

HALLOWEEN DRAWINGS NUMBER KEY

[1. Halloween novelty item]
[2. Face]
[3. Right head cavity]
[4 Rear head cavity]
[5. Left head cavity]
[6. Fluid jug]
[7. Fluid jug cap]
[8. Left ear]
[9. ¾ in. wood screw]
[10. Nose]
[11. 2 in wood screw]
[12. Lips]
[13. Tube]
[14. Two way splitter]
[15. Tongue]
[16. Heave duty wire twist]
[17. 1 in. bolt with nut]
[18. Chin]
[19. Right ear]
[20. Support rail]
[21. Elbow fitting]
[22. Electromagnetic valve]
[23. Wire connectors]
[24. Rubber belt]
[25. Fitting]
[26. Rubber washer]
[27. Flat nut]
[28. Right upper neck brackets]
[29. Right lower neck bracket]
[30. Bolt with locking nut]

[31. Bolt and nut with washer]
[32. Plastic insert]
[33. Left and Right upper body panels]
[34. Rear upper body panel]
[35. Front upper body panel]
[36. Shoulder reinforcement piece]
[37. Eye bolt]
[38. Bolt and nut with lock washer and washer]
[39. Male bucket bracket]
[40. Left lower body panel]
[41. Front lower body panel]
[42. Hinge assembly]
[43. Hinge]
[44. Hinge, lower reinforcement piece]
[45. Hinge, upper reinforcement piece]
[46. Flat head bolt and nut with spacer, lock washer, and washer]
[47. Latch assembly]
[48. Latch, upper reinforcement piece]
[49. Latch, lower reinforcement piece]
[50. Latch holder]
[51. Latch lever]
[52. Machine screw and nut with lock washer]
[53. Electromagnetic valve wiring]
[54. Speaker]
[55. Timer]
[56. 9 vdc relay]
[57. Wiring harness clamp]
[58. Wiring harness]
[59. Voice recorder]
[60. Right lower body panel]
[61. Front lower body panel]
[62. Access panel]
[63. Shoulder foam]
[64. Right and Left body foam]
[65. Front upper body foam]
[66. Right and left lower body foam]
[67. Front lower body foam]
[68. Shoulder panel assemblies]
[69. 4 in wood screw]
[70. Chain link]
[71. Pipe insulation]
[72. Left glove with paper]
[73. Hook]
[74. Right glove with paper]
[75. Bucket]
[76. Bucket handle]
[77. Bucket reinforcement piece]
[78. Female, Bucket bracket]
[79. Machine screw with nut, lock washer and washer]
[80. Machine screw with nut, lock washer and two washers]
[81. 3 in bolt with nut, lock washer and washer]
[82. Left and Right hip panels]
[83. Front and back hip panels]
[84. Front and rear leg panels]
[85. Left and right leg panels]
[86. Shoe lace]
[87. Right running shoe]
[88. Left running shoe]
[89. Stabilization board]
[90. Moss mat]
[91. Leg reinforcement piece]
[92. Battery box assembly]
[93. Rear motion sensor box panel]
[94. Right and left motion sensor box panels]
[95. Front motion sensor box panel]
[96. 2½ in wood screw]
[97. Motion sensor box assembly]
[98. Motion sensor box access lid]
[99. Motion sensor, right]
[100. Motion sensor, front right]
[101. Motion sensor, front left]
[102. Motion sensor, left]
[103. Battery box]
[104. Volume control]
[105. Ac/dc plug in connector]
[106. On/on switch]
[107. Battery cushion foam]
[108. On/off switch, messages]
[109. Battery pack, 12v]
[110. Battery box cover]
[111. Foam insert]
[112. Straps]
[113. Wig]
[114. Sweat pants]
[115. Flannel shirt]
[116. Neck fabric]
[117. Magnets]
[118. Ac/dc power converter]
[119. Amp option]
[120. Spacer]
[121. On/off switch, (throw up)]

The invention claimed is:

1. A Halloween novelty item used for entertainment appearing to throw up into a bucket that it is holding; comprising a reservoir of fluid inside a head cavity,
a tube,
an electromagnetic valve coupled to the reservoir of fluid and the tube,
a bucket having a bucket handle,
a motion sensor coupled to the electromagnetic valve
a power supply; and
a body panel assembly comprising:
a pair of arms made out of a chain link with pipe insulation,
a pair of gloves with hooks attached to the arms; and
a detachable slide bracket coupling the body panel assembly to the bucket such that the bucket can be removed from the body panel assembly;
such that when someone approaches the front of the Halloween novelty item, the motion sensor communicates with the electromagnetic valve allowing it open, permitting a flow of fluid from the reservoir of fluid through the tube into the bucket via gravity.

2. The Halloween novelty item in claim 1, further comprising a timer connected to the electromagnetic valve and the motion sensor such to permit an intermittent flow of fluid through the tube into the bucket.

3. The Halloween novelty item in claim 1, further comprising a two way splitter located on a tongue connected to the tube permitting the flow of fluid into the bucket from two orifices.

4. The Halloween novelty item in claim 1, in which the reservoir of fluid comprises a refillable fluid jug with a cap.

5. The Halloween novelty item in claim 4, further comprising a removable neck fabric utilizing magnets for allowing access to the tube, the reservoir of fluid and the electromagnetic valve, permitting removal of the fluid jug from the Halloween novelty item.

6. The Halloween novelty item in claim 4, further comprising a pair of rails on which the fluid jug rests, and a rubber belt attached to the fluid jug and the inside of the head cavity permitting the reservoir of fluid to be removed to dispose of any unused fluid and be held in place when removing or replacing the cap.

7. The Halloween novelty item in claim 1, further comprising a hinge assembly and latches attached to the body panel assembly permitting the Halloween novelty item to fold in half.

8. The Halloween novelty item in claim 1, further comprising a stabilization board which is positioned at the bottom of the Halloween novelty item to cope with any shifting in weight from the head cavity of the Halloween novelty item to the bucket of the Halloween novelty item.

9. The Halloween novelty item of claim 1, further comprising:

a voice recorder storing a plurality of messages, a speaker coupled to the voice recorder, and three motion sensors coupled to the voice recorder which face different directions, the voice recorder being controlled by the motion sensors such that when a motion sensor senses that the Halloween novelty item has been approached, a message associated with the sensor is selected from the plurality of messages stored in the voice recorder and played, such that a different message from the plurality of messages is played for each of the three motion sensors.

10. The Halloween novelty item in claim 9, in which the plurality of messages are organized into at least two sets of three messages, and the Halloween novelty item further comprises a message switch coupled to the voice recorder, such that operating the message switch selects between two sets of three different messages from the plurality of messages stored in the voice recorder to play when the Halloween novelty item is approached.

* * * * *

UNITED STATES PATENT AND TRADEMARK OFFICE

CERTIFICATE OF CORRECTION

PATENT NO. : 7,878,878 B2
APPLICATION NO. : 12/168193
DATED : February 1, 2011
INVENTOR(S) : Massaro It is certified that error appears in the above-identified patent and that said Letters Patent is hereby corrected as shown below:

The title page, showing an illustrative figure, should be deleted and substitute therefor the attached title page showing an illustrative figure.

Delete drawing sheets 1-14 and substitute therefor the drawing sheets 1-14 consisting of figures 1-28 as shown on the attached pages.

Signed and Sealed this
Twenty-sixth Day of April, 2011

David J. Kappos

David J. Kappos
*Director of the United States Patent and Trademark Office*

(12) United States Patent
Massaro

(10) Patent No.: US 7,878,878 B2
(45) Date of Patent: Feb. 1, 2011

(54) LIFE SIZE HALLOWEEN NOVELTY ITEM

(76) Inventor: Darren S. Massaro, 65 Hunter Rd., Lincoln Park, NJ (US) 07035

( * ) Notice: Subject to any disclaimer, the term of this patent is extended or adjusted under 35 U.S.C. 154(b) by 0 days.

(21) Appl. No.: 12/168,193

(22) Filed: Jul. 7, 2008

(65) Prior Publication Data

US 2010/0003888 A1 Jan. 7, 2010

(51) Int. Cl.
*A63H 13/02* (2006.01)

(52) U.S. Cl. ..... 446/296; 446/130; 446/166; 446/167; 446/295; 446/297; 446/304; 446/369; 446/397; 446/399; 446/472; 446/484; 446/489; 446/175; 446/475; 369/30.02; 434/1; 434/86; 434/256; D2/741

(58) Field of Classification Search ..... 446/130, 446/175, 166, 167, 295, 296, 297, 304, 369, 446/397, 399, 472, 489; 369/30.02; D2/741; 434/1, 86, 256
See application file for complete search history.

(56) References Cited

U.S. PATENT DOCUMENTS 1,937,397 A * 11/1933 Averill ..... 446/295
2,725,575 A * 12/1955 Colonna ..... 4/312
2,748,256 A * 5/1956 Moran ..... 362/362
2,883,794 A * 4/1959 Julius Ellman ..... 446/167
3,100,588 A * 8/1963 Pearson, Jr. ..... 222/156
3,250,910 A * 5/1966 Authier ..... 40/540
3,363,904 A * 1/1968 Elwell ..... 369/30.02
3,636,655 A * 1/1972 Porter et al. ..... 446/302
3,789,544 A * 2/1974 Thorn ..... 446/167
3,828,462 A * 8/1974 Morrison et al. ..... 446/167
3,837,111 A * 9/1974 Godfrey et al. ..... 446/73
3,883,986 A * 5/1975 Thorn ..... 446/167
3,888,023 A * 6/1975 Genin ..... 434/256
3,890,907 A * 6/1975 Peterson ..... 108/136
4,209,939 A * 7/1980 Pittala ..... 446/267
4,226,902 A * 10/1980 Webb ..... 428/7
4,257,188 A * 3/1981 Barker ..... 446/295
D262,097 S * 12/1981 Weixelman ..... D11/118
4,375,733 A * 3/1983 Callais, Jr. ..... 446/295
4,479,329 A * 10/1984 Fraden ..... 446/175
4,575,351 A * 3/1986 Gonzalez ..... 446/371
4,582,317 A * 4/1986 Provenzano, Jr. ..... 472/70
4,683,588 A * 7/1987 Goldberg ..... 381/61
4,690,653 A * 9/1987 Goldberg ..... 446/27

(Continued)

*Primary Examiner*—Gene Kim
*Assistant Examiner* Alexander R Niconovich
(74) *Attorney, Agent, or Firm*—Brown & Michaels, PC; Michael F. Brown

(57) ABSTRACT

A Halloween novelty item used for entertainment consisting of a removable reservoir of fluid and a timed electromagnetic valve inside a head that is activated by a motion sensor whereby allowing fluid to expel intermittently out of orifices attached to a tongue when the Halloween novelty item is approached. The expelled fluid is caught by a bucket attached to a slide bracket which is attached to a body panel whereby allowing the bucket to be removable. An assembly attached to a bucket handle consisting of a pair of hooks attached to a pair of hands connected to a pair of flexible arms allows the assembly to detach from the bucket's handle. A stabilization board keeps the novelty item stable. Motion sensors facing different directions are attached to a voice recorder and a speaker allowing messages to play. A hinge and latches attached to the body allows the invention to condense.

10 Claims, 14 Drawing Sheets

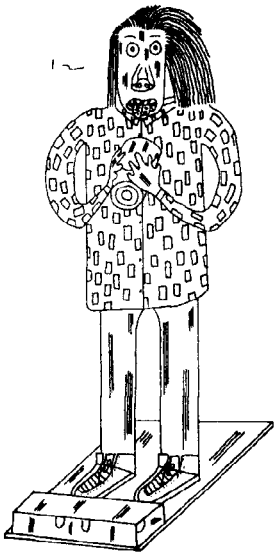

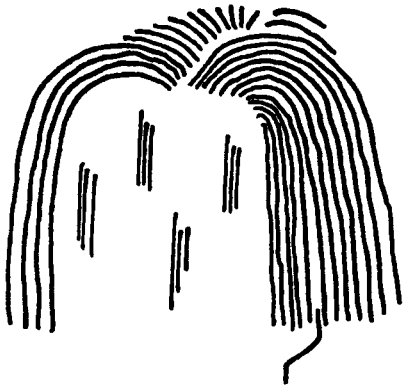
FIG.26A
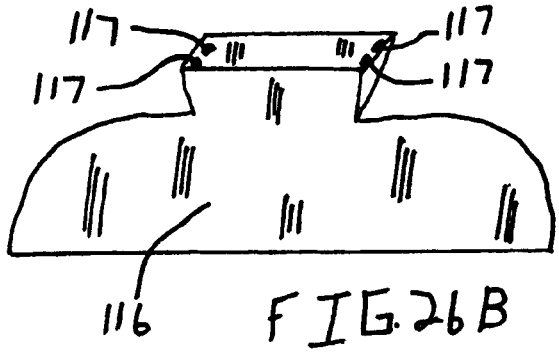
FIG.26B
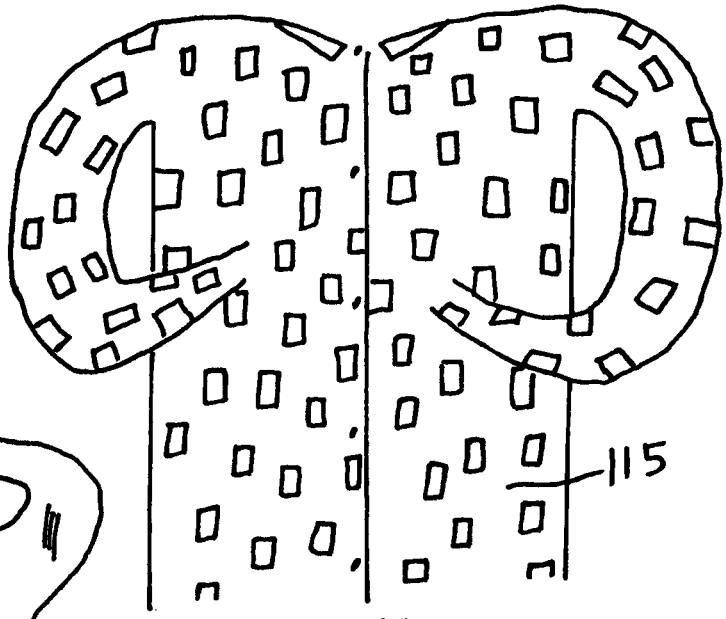
FIG.26C
FIG.26D
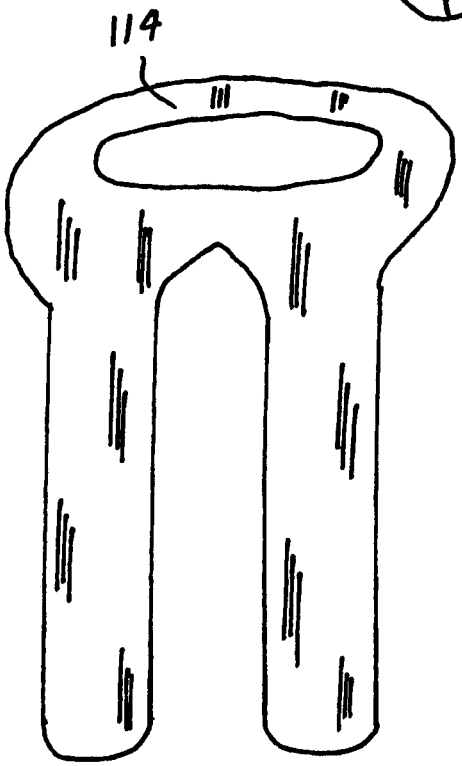
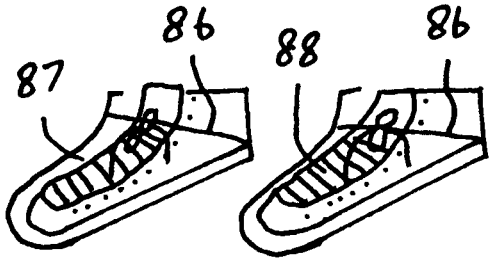
FIG.26E